US011581688B2

(12) United States Patent
Lin et al.

(10) Patent No.: US 11,581,688 B2
(45) Date of Patent: Feb. 14, 2023

(54) HIGH-SPEED CONNECTOR

(71) Applicant: Cheng Uei Precision Industry Co., LTD., New Taipei (TW)

(72) Inventors: Pei-Yi Lin, New Taipei (TW); Yi-Ching Hsu, New Taipei (TW); Sheng-Yuan Huang, New Taipei (TW); Chun-Fu Lin, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 32 days.

(21) Appl. No.: 17/474,016

(22) Filed: Sep. 13, 2021

(65) Prior Publication Data

US 2022/0344877 A1 Oct. 27, 2022

(30) Foreign Application Priority Data

Apr. 23, 2021 (CN) ..... 202120851289.3

(51) Int. Cl.

| | |
|---|---|
| ***H01R 13/6597*** | (2011.01) |
| ***H01R 12/72*** | (2011.01) |
| ***H01R 13/42*** | (2006.01) |
| ***H01R 12/70*** | (2011.01) |
| ***H01R 13/6471*** | (2011.01) |

(52) U.S. Cl.

CPC ..... *H01R 13/6597* (2013.01); *H01R 12/707* (2013.01); *H01R 12/72* (2013.01); *H01R 13/42* (2013.01); *H01R 13/6471* (2013.01)

(58) Field of Classification Search

CPC ..... H01R 13/6461; H01R 13/6471; H01R 13/6585; H01R 13/6586; H01R 13/6587; H01R 13/6597; H01R 13/6473; H01R 13/6474; H01R 13/42; H01R 12/57; H01R 12/73; H01R 12/712; H01R 12/714;

(Continued)

(56) References Cited

U.S. PATENT DOCUMENTS 6,231,355 B1 * 5/2001 Trammel ..... H01R 12/721 439/79
6,764,342 B2 * 7/2004 Murayama ..... H01R 13/65918 439/607.1

(Continued)

FOREIGN PATENT DOCUMENTS

CN 107394442 A * 11/2017 ..... H01R 13/02
CN 113328296 A * 8/2021
TW M625890 U * 4/2022

*Primary Examiner* — Marcus E Harcum
(74) *Attorney, Agent, or Firm* — Cheng-Ju Chiang

(57) ABSTRACT

A high-speed connector includes an insulating housing, and a first terminal assembly mounted in the insulating housing. The first terminal assembly includes a plurality of first terminals including a plurality of first grounding terminals, a first base body, and a first shielding plate disposed under the first base body. The plurality of the first terminals are fastened to the first base body. The first shielding plate has a first base plate, a first metal layer and a plurality of first ribs. Several portions of a top surface of the first base plate extend upward to form the plurality of the first ribs. The first metal layer is a pattern with a plurality of pores. Several of the first grounding terminals contact with the first metal layer which is attached to top surfaces of the plurality of the first ribs to form a grounding structure.

20 Claims, 23 Drawing Sheets

(58) Field of Classification Search
CPC .... H01R 12/716; H01R 12/72; H01R 12/724; H01R 12/727; H01R 12/707; H01R 24/60
USPC ..... 439/637, 660
See application file for complete search history.

(56) References Cited

U.S. PATENT DOCUMENTS 7,163,421 B1* 1/2007 Cohen ..... H01R 13/6599 439/607.02
7,530,839 B1* 5/2009 Lee ..... H01R 12/592 439/496
7,581,990 B2* 9/2009 Kirk ..... H01R 13/514 439/607.05
8,167,652 B1* 5/2012 Ju ..... H01R 13/6599 29/592.1
8,177,564 B1* 5/2012 Ito ..... H01R 13/6471 439/108
8,523,583 B2* 9/2013 Ito ..... H01R 12/721 439/108
8,771,018 B2* 7/2014 McGrath ..... H01R 12/55 439/630
8,926,377 B2* 1/2015 Kirk ..... H01R 12/721 439/701
9,065,230 B2* 6/2015 Milbrand, Jr. ..... H01R 12/7005
9,337,585 B1* 5/2016 Yang ..... H01R 13/6583
9,409,331 B2* 8/2016 Liu ..... H01R 13/504
9,431,768 B1* 8/2016 Champion ..... H01R 13/6585
9,461,423 B2* 10/2016 Tsai ..... H01R 12/724
9,472,900 B1* 10/2016 Phillips ..... H01R 13/6471
9,490,588 B2* 11/2016 Keyser ..... H01R 12/53
9,496,657 B1* 11/2016 Chang ..... H01R 13/6471
9,531,130 B1* 12/2016 Phillips ..... H01R 13/6471
9,577,370 B2* 2/2017 Lin ..... H01R 13/6471
9,614,333 B2* 4/2017 Tsai ..... H01R 13/52
9,653,851 B1* 5/2017 Yuan ..... H01R 13/6594
9,666,998 B1* 5/2017 de Boer ..... H01R 13/6596
9,768,557 B2* 9/2017 Phillips ..... H01R 13/6585
9,768,568 B1* 9/2017 Jin ..... H01R 24/60
9,859,635 B1* 1/2018 Pickel ..... H01R 12/73
9,972,945 B1* 5/2018 Huang ..... H01R 13/6585
9,979,136 B1* 5/2018 Wu ..... H01R 13/6597
10,050,369 B1* 8/2018 Yang ..... H01R 13/502
10,084,245 B2* 9/2018 Chang ..... H01R 13/6658
10,135,197 B2* 11/2018 Little ..... H01R 12/58
10,218,088 B2* 2/2019 Chang ..... H01R 13/6586
10,283,910 B1* 5/2019 Chen ..... H01R 4/04
10,367,308 B2* 7/2019 Little ..... H01R 13/6658
10,374,367 B2* 8/2019 Maesoba ..... H01R 13/6589
10,411,376 B1* 9/2019 Wang ..... H01R 13/502
10,468,829 B2* 11/2019 Zerebilov ..... H01R 13/516
10,476,192 B2* 11/2019 Huang ..... H01R 12/725
10,530,100 B1* 1/2020 Henry ..... H01R 13/6587
10,644,455 B1* 5/2020 Champion ..... H01R 13/6464
10,777,921 B2* 9/2020 Lu ..... H01R 12/7005
10,840,622 B2* 11/2020 Sasame ..... H01R 13/514
10,916,891 B2* 2/2021 Hsu ..... H01R 13/6585
10,944,189 B2* 3/2021 Xu ..... H01R 12/75
11,025,013 B2* 6/2021 Little ..... H01R 13/6587
11,108,194 B2* 8/2021 Lin ..... H01R 13/6471
11,114,807 B2* 9/2021 Lloyd ..... H01R 24/60
11,251,558 B1* 2/2022 Lee ..... H01R 13/6599
2004/0077221 A1* 4/2004 Peloza ..... H01R 13/6477 439/676
2005/0095912 A1* 5/2005 Yang ..... H01R 13/65912 439/607.15
2006/0234556 A1* 10/2006 Wu ..... H01R 12/721 439/607.05
2009/0111325 A1* 4/2009 Ju ..... H01R 13/6599 439/607.55
2009/0227147 A1* 9/2009 Momose ..... H05K 1/0243 439/638
2011/0151716 A1* 6/2011 Kondo ..... H01R 13/6471 439/660
2012/0115371 A1* 5/2012 Chuang ..... H01R 24/60 439/660
2012/0184145 A1* 7/2012 Zeng ..... H01R 13/6585 439/626
2012/0202363 A1* 8/2012 McNamara ..... H01R 13/516 439/74
2012/0282808 A1* 11/2012 Luo ..... H01R 13/6471 439/628
2013/0052843 A1* 2/2013 Johnescu ..... H01R 13/658 439/95
2013/0089991 A1* 4/2013 Ito ..... H01R 12/721 439/65
2013/0178115 A1* 7/2013 Ao ..... H01R 13/6473 439/682
2014/0127946 A1* 5/2014 Ito ..... H01R 13/6599 439/629
2014/0273627 A1* 9/2014 Cartier, Jr. ..... H01R 13/6476 439/607.11
2015/0031240 A1* 1/2015 Yang ..... H01R 13/6588 439/607.08
2015/0079845 A1* 3/2015 Wan ..... H01R 13/6477 439/607.41
2015/0188250 A1* 7/2015 Liu ..... H01R 13/504 439/86
2015/0255904 A1* 9/2015 Ito ..... H01R 12/721 439/88
2015/0288108 A1* 10/2015 Fischer ..... H01R 13/6584 439/271
2016/0049746 A1* 2/2016 Gross ..... H01R 13/6461 439/660
2016/0104956 A1* 4/2016 Santos ..... H01R 13/2421 439/86
2016/0218455 A1* 7/2016 Sayre ..... H01R 13/6594
2017/0018880 A1* 1/2017 Phillips ..... H01R 13/6585
2017/0047689 A1* 2/2017 Yao ..... H01R 12/716
2017/0085021 A1* 3/2017 Tsai ..... H01R 4/02
2017/0085037 A1* 3/2017 Chen ..... H01R 13/08
2017/0170606 A1* 6/2017 Phillips ..... H01R 13/6471
2017/0179651 A1* 6/2017 Chen ..... H01R 13/6471
2018/0034216 A1* 2/2018 Zhong ..... H01R 4/027
2018/0040971 A1* 2/2018 Phillips ..... H01R 12/737
2018/0062323 A1* 3/2018 Kirk ..... H01R 13/6594
2018/0097310 A1* 4/2018 Ju ..... H01R 9/03
2018/0115117 A1* 4/2018 Yu ..... H01R 12/79
2019/0089077 A1* 3/2019 Huang ..... H01R 12/716
2019/0097357 A1* 3/2019 Mongold ..... H01R 12/724
2019/0148887 A1* 5/2019 Chen ..... H01R 13/6471 439/660
2019/0165518 A1* 5/2019 Hsu ..... H01R 13/6471
2019/0173237 A1* 6/2019 Oosaka ..... H01R 13/26
2019/0181570 A1* 6/2019 Ellis ..... H01R 13/65914
2019/0190210 A1* 6/2019 Zhong ..... H01R 13/6596
2019/0252833 A1* 8/2019 Li ..... H01R 13/652
2019/0293884 A1* 9/2019 Little ..... G02B 6/3897
2019/0296469 A1* 9/2019 Stokoe ..... H01R 12/716
2019/0372274 A1* 12/2019 Feng ..... H01R 13/46
2020/0067235 A1* 2/2020 Long ..... H01R 13/6471
2020/0076132 A1* 3/2020 Yang ..... H01R 12/73
2020/0076135 A1* 3/2020 Tang ..... H01R 12/724
2020/0091659 A1* 3/2020 Tada ..... H01R 43/16
2020/0099149 A1* 3/2020 Xu ..... H01R 13/6461
2020/0194911 A1* 6/2020 Ayzenberg ..... H01R 13/6594
2020/0212636 A1* 7/2020 Chang ..... H01R 13/6474
2020/0233823 A1* 7/2020 Zhang ..... G06F 13/40
2020/0266584 A1* 8/2020 Lu ..... H01R 12/75
2020/0350731 A1* 11/2020 Buck ..... H01R 13/6471
2020/0350732 A1* 11/2020 Hsueh ..... H01R 13/40
2020/0403366 A1* 12/2020 Cai ..... H01R 43/16
2020/0412060 A1* 12/2020 Hsieh ..... H01R 13/6471
2021/0044060 A1* 2/2021 Wu ..... H01R 12/57
2021/0075163 A1* 3/2021 Takai ..... H05K 1/0219
2021/0075164 A1* 3/2021 Chen ..... H01R 13/502
2021/0126385 A1* 4/2021 Zhang ..... H01R 13/6473
2021/0126403 A1* 4/2021 Zhang ..... H01R 12/716
2021/0135389 A1* 5/2021 Jiang ..... H01R 13/6461
2021/0135403 A1* 5/2021 Yang ..... H01R 13/6471
2021/0203104 A1* 7/2021 Chen ..... H01R 13/405
2021/0234291 A1* 7/2021 Zerebilov ..... H01R 13/405

(56) References Cited

U.S. PATENT DOCUMENTS

| | | | | |
|---|---|---|---|---|
| 2021/0257772 | A1* | 8/2021 | Ishii | H01R 13/6585 |
| 2021/0265792 | A1* | 8/2021 | Blackburn | H01R 24/60 |
| 2021/0313721 | A1* | 10/2021 | Little | H01R 12/71 |
| 2021/0313748 | A1* | 10/2021 | Henry | H01R 13/642 |
| 2021/0320448 | A1* | 10/2021 | Chung | H01R 13/42 |
| 2021/0336360 | A1* | 10/2021 | Kolak | H01R 13/502 |
| 2021/0367361 | A1* | 11/2021 | Phillips | H01R 12/721 |
| 2022/0029358 | A1* | 1/2022 | Lin | H01R 12/727 |
| 2022/0029359 | A1* | 1/2022 | Lin | H05K 1/117 |
| 2022/0029360 | A1* | 1/2022 | Little | H01R 13/65914 |
| 2022/0037836 | A1* | 2/2022 | Huang | H01R 12/716 |
| 2022/0102918 | A1* | 3/2022 | Kobayashi | H01R 13/65914 |
| 2022/0115817 | A1* | 4/2022 | Huang | H01R 13/6471 |
| 2022/0158388 | A1* | 5/2022 | Chung | H01R 13/6474 |
| 2022/0173550 | A1* | 6/2022 | Liu | H01R 13/6592 |

* cited by examiner

HIGH-SPEED CONNECTOR

CROSS-REFERENCE TO RELATED APPLICATION

The present application is based on, and claims priority from, China Patent Application No. 202120851289.3, filed Apr. 23, 2021, the disclosure of which is hereby incorporated by reference herein in its entirety.

BACKGROUND OF THE INVENTION

1. Field of the Invention

The present invention generally relates to a high-speed connector, and more particularly to a high-speed connector which is capable of reducing a resonance point and is capable of improving a far-end crosstalk a near-end crosstalk, an insertion loss and a return loss.

2. The Related Art

Nowadays, a high-speed connector is usually connected to several grounding terminals by a ground plate, so an insertion loss and a crosstalk are reduced. The ground plate includes a main body, and a plurality of elastic arms extended from the main body. The main body is shown as a sheet shape. The plurality of the elastic arms are mostly integrally stamped with the main body, and each elastic arm is shown as a cantilever beam form. However, a structural strength of the ground plate is insufficient, and the ground plate hardly shields differential signal terminals of the high-speed connector, so the ground plate can be further improved to be beneficial to improve a performance of the high-speed connector.

A conventional high-speed connector includes a housing, an insulating core inserted into the housing, a plurality of terminals fastened to the insulating core, and a shielding element. The plurality of the terminals include a plurality of first conductive terminals fastened to the insulating core, and a plurality of second conductive terminals fixed to the insulating core. The plurality of the first conductive terminals are arranged along a transverse direction. The plurality of the first conductive terminals include two differential signal terminals and two grounding terminals. The two grounding terminals are located adjacent to two outer sides of the two differential signal terminals. The two outer sides of the two differential signal terminals are opposite to each other. The shielding element has a substrate assembled to the housing, and a metal plating layer plated to the substrate. The metal plating layer is designed as a whole piece without pores. Two portions of the metal plating layer contacts the two grounding terminals to establish an electrical connection between the two grounding terminals. The two portions of the metal plating layer are arranged at the two outer sides of the two differential signal terminals, so the metal plating layer shields the two differential signal terminals along the transverse direction.

However, the shielding plate of the conventional high-speed connector described above is covered with the metal plating layer to achieve a shielding function, the conventional high-speed connector has following disadvantages, when a signal is radiated towards the metal plating layer, a signal reflection is generated, and an oscillation is easily caused to generate many unnecessary resonance points. When the conventional high-speed connector transmits higher speed signals, a high-frequency characteristic of the high-speed connector becomes poorer. When the higher speed signals are transmitted among adjacent terminals, a crosstalk interference of the conventional high-speed connector is hardly avoided. Moreover, the shielding plate of the conventional high-speed connector is covered with the metal layer to make the high-frequency characteristic poorer, so a crosstalk phenomenon is caused. In addition, the oscillation causes more insertion losses and more return losses.

Thus, it is essential to provide an innovative high-speed connector which is capable of reducing a resonance point and is capable of improving a far-end crosstalk, a near-end crosstalk, an insertion loss and a return loss.

SUMMARY OF THE INVENTION

An object of the present invention is to provide a high-speed connector. The high-speed connector includes an insulating housing and a first terminal assembly. The first terminal assembly is mounted in the insulating housing. The first terminal assembly includes a plurality of first terminals, a first base body and a first shielding plate. The plurality of the first terminals are fastened to the first base body, and the plurality of the first terminals are partially surrounded by the first base body. The first shielding plate is disposed under the first base body. The plurality of the first terminals include a plurality of first grounding terminals and a plurality of first signal terminals. Each two adjacent first signal terminals are located between two first grounding terminals. The first shielding plate has a first base plate, a first metal layer and a plurality of first ribs. Several portions of a top surface of the first base plate extend upward to form the plurality of the first ribs. The first metal layer is disposed on the top surface of the first base plate and top surfaces of the plurality of the first ribs. The first metal layer is a pattern with a plurality of pores. The plurality of the pores are formed by a plurality of interlaced lines, and the plurality of the interlaced lines are extended on the top surface of the first base plate and the top surfaces of the plurality of the first ribs. Several of the first grounding terminals contact with the first metal layer which is attached to the top surfaces of the plurality of the first ribs to form a grounding structure.

Another object of the present invention is to provide a high-speed connector. The high-speed connector includes an insulating housing, a first terminal assembly mounted in the insulating housing, and a second terminal assembly. The first terminal assembly includes a plurality of first terminals, a first base body and a first shielding plate. The plurality of the first terminals are partially surrounded by the first base body. The first shielding plate is disposed under the first base body. The plurality of the first terminals include a plurality of first grounding terminals and a plurality of first signal terminals. Each two adjacent first signal terminals are located between two first grounding terminals. The first shielding plate has a first base plate, a first metal layer and a plurality of first ribs. Several portions of a top surface of the first base plate of the first shielding plate extend upward to form the plurality of the first ribs. The first metal layer is disposed on the top surface of the first base plate and top surfaces of the plurality of the first ribs. The first metal layer is designed to be a pattern with a plurality of pores. The plurality of the pores are formed by a plurality of interlaced lines. Several of the first grounding terminals contact with the first metal layer which is attached to the top surfaces of the plurality of the first ribs to form a grounding structure. The second terminal assembly is mounted in the insulating housing. The second terminal assembly is corresponding to the first terminal assembly. The second terminal assembly includes a plurality of second terminals, a second base body and a second shielding plate. The plurality of the second terminals are partially surrounded by the second base body. The second shielding plate is disposed on the second base body. The plurality of the second terminals include a plurality of second grounding terminals and a plurality of second signal terminals. Each two adjacent second signal terminals are located between two second grounding terminals. The second shielding plate has a second base plate, a second metal layer and a plurality of second ribs. Several portions of a bottom surface of the second base plate of the second shielding plate extend downward to form the plurality of the second ribs. The second metal layer is disposed under the bottom surface of the second base plate and bottom surfaces of the plurality of the second ribs. The second metal layer is designed to be the pattern with the plurality of the pores. The plurality of the pores are formed by the plurality of the interlaced lines. Several of the second grounding terminals contact with the second metal layer which is attached to the bottom surfaces of the plurality of the second ribs to form the grounding structure.

Another object of the present invention is to provide a high-speed connector. The high-speed connector includes an insulating housing and a terminal module. The terminal module includes a first terminal assembly, a second terminal assembly, a third terminal assembly and a fourth terminal assembly. The first terminal assembly includes a plurality of first terminals, a first base body and a first shielding plate. The plurality of the first terminals are fastened to the first base body, and the plurality of the first terminals are partially surrounded by the first base body. The first shielding plate is disposed under the first base body. The plurality of the first terminals include a plurality of first grounding terminals and a plurality of first signal terminals. Each two adjacent first signal terminals are located between two first grounding terminals. The first shielding plate has a first base plate, a first metal layer and a plurality of first ribs. Several portions of a top surface of the first base plate of the first shielding plate extend upward to form the plurality of the first ribs. The first metal layer is disposed on the top surface of the first base plate and top surfaces of the plurality of the first ribs. The first metal layer is designed to be a pattern with a plurality of pores. The plurality of the pores are formed by a plurality of interlaced lines. Several of the first grounding terminals contact with the first metal layer which is attached to the top surfaces of the plurality of the first ribs to form a grounding structure. The second terminal assembly is corresponding to the first terminal assembly. The second terminal assembly includes a plurality of second terminals, a second base body and a second shielding plate. The plurality of the second terminals are fastened to the second base body. The plurality of the second terminals are partially surrounded by the second base body. The second shielding plate is disposed on the second base body. The plurality of the second terminals include a plurality of second grounding terminals and a plurality of second signal terminals. Each two adjacent second signal terminals are located between two second grounding terminals. The second shielding plate has a second base plate, a second metal layer and a plurality of second ribs. Several portions of a bottom surface of the second base plate of the second shielding plate extend downward to form the plurality of the second ribs. The second metal layer is disposed under the bottom surface of the second base plate and bottom surfaces of the plurality of the second ribs. The second metal layer is designed to be the pattern with the plurality of the pores. The plurality of the pores are formed by the plurality of the interlaced lines. Several of the second grounding terminals contact with the second metal layer which is attached to the bottom surfaces of the plurality of the second ribs to form the grounding structure. The third terminal assembly includes a plurality of third terminals, a third base body and a third shielding plate. The plurality of the third terminals are fastened to the third base body. The plurality of the third terminals are partially surrounded by the third base body. The third shielding plate is disposed under the third base body. The plurality of the third terminals include a plurality of third grounding terminals and a plurality of third signal terminals. Each two adjacent third signal terminals are located between two third grounding terminals. The third shielding plate has a third base plate, a third metal layer and a plurality of third ribs. Several portions of a top surface of the third base plate of the third shielding plate extend upward to form the plurality of the third ribs. The third metal layer is disposed on the top surface of the third base plate and top surfaces of the plurality of the third ribs. The third metal layer is designed to be the pattern with the plurality of the pores. The plurality of the pores are formed by the plurality of the interlaced lines. Several of the third grounding terminals contact with the third metal layer which is attached to the top surfaces of the plurality of the third ribs to form the grounding structure. The fourth terminal assembly is corresponding to the third terminal assembly. The fourth terminal assembly includes a plurality of fourth terminals, a fourth base body and a fourth shielding plate. The fourth base body surrounds the plurality of the fourth terminals. The plurality of the fourth terminals are fastened to the fourth base body. The plurality of the fourth terminals are partially surrounded by the fourth base body. The fourth shielding plate is disposed under the fourth base body. The plurality of the fourth terminals include a plurality of fourth grounding terminals and a plurality of fourth signal terminals. Each two adjacent fourth signal terminals are located between two fourth grounding terminals. The fourth shielding plate has a fourth base plate, a fourth metal layer and a plurality of fourth ribs. Several portions of a top surface of the fourth base plate of the fourth shielding plate extend upward to form the plurality of the fourth ribs. The fourth metal layer is disposed on the top surface of the fourth base plate and top surfaces of the plurality of the fourth ribs. The fourth metal layer is designed to be the pattern with the plurality of the pores. The plurality of the pores are formed by the plurality of the interlaced lines. Several of the fourth grounding terminals contact with the fourth metal layer which is attached to the top surfaces of the plurality of the fourth ribs to form the grounding structure.

As described above, the first metal layer is mounted to the first base body, the second metal layer is mounted to the second base body, the third metal layer is mounted to the third base body and the fourth metal layer is mounted to the fourth base body of the terminal module of the high-speed connector. The first metal layer, the second metal layer, the third metal layer and the fourth metal layer are the same patterns with the plurality of the pores, and the plurality of the pores of the patterns may be different, so the signals partially penetrate through the first shielding plate, the second shielding plate, the third shielding plate and the fourth shielding plate, and the signals are partially reflected by the first shielding plate, the second shielding plate, the third shielding plate and the fourth shielding plate. As a result, the high-speed connector is less liable to generate the resonance point, and the performances of the far-end crosstalk, the near-end crosstalk, the insertion loss and the return loss are better.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
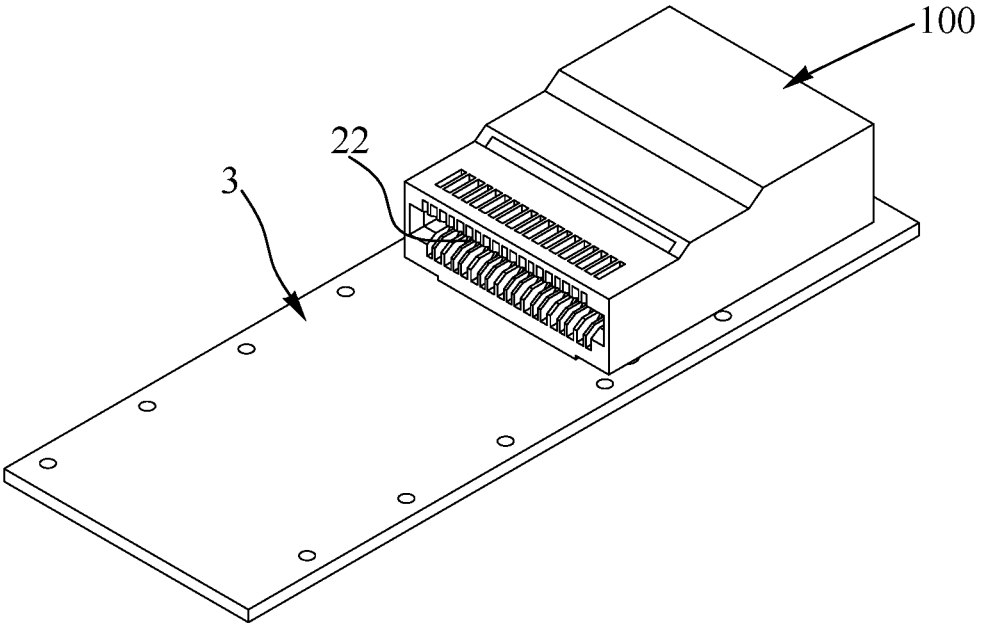
FIG. 1 is a perspective view of a high-speed connector in accordance with a preferred embodiment of the present invention, wherein the high-speed connector is fastened to a circuit board.
Figure 2:
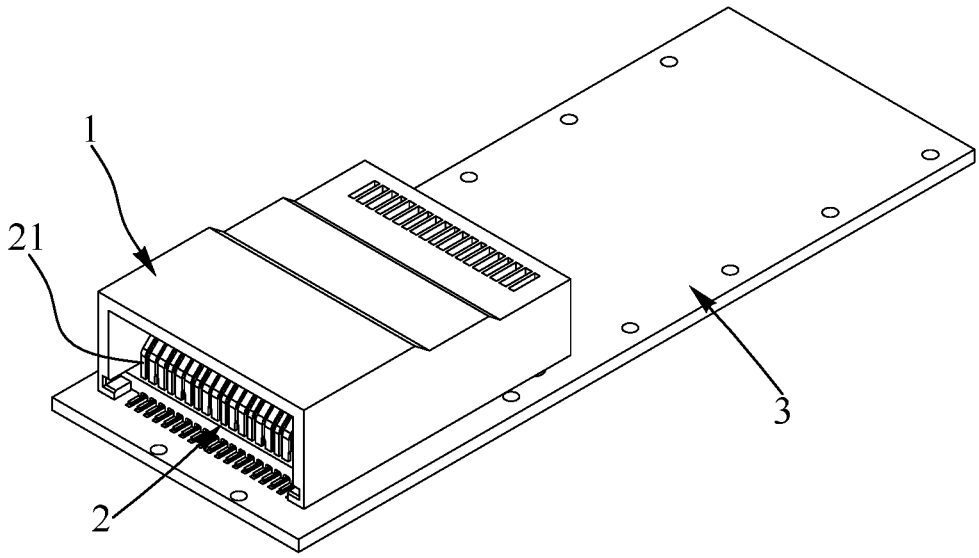
FIG. 2 is another perspective view of the high-speed connector of FIG. 1, wherein the high-speed connector is fastened to the circuit board.

With reference to FIG. 1 and FIG. 2, a high-speed connector 100 in accordance with a preferred embodiment of the present invention is shown. The high-speed connector 100 includes an insulating housing 1 and a terminal module 2. The high-speed connector 100 is disposed on a circuit board 3. The insulating housing 1 is fastened on the circuit board 3. Terminal module 2 is disposed in the insulating housing 1. The terminal module 2 is soldered to the circuit board 3.

Figure 23:
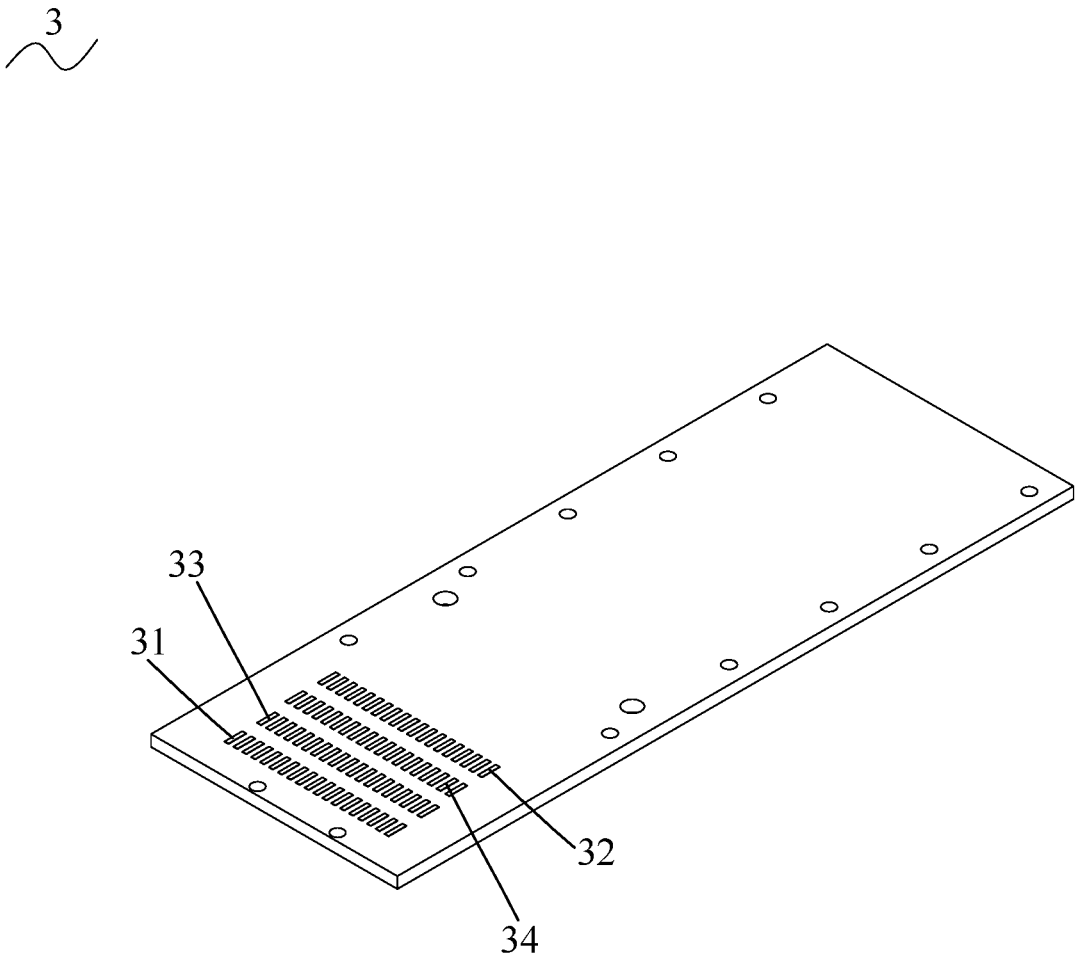
FIG. 23 is a perspective view of a circuit board of the high-speed connector of FIG. 1.

Referring to FIG. 23, the circuit board 3 has a first soldering zone 31, a second soldering zone 32, a third soldering zone 33 and a fourth soldering zone 34. The first soldering zone 31, the second soldering zone 32, the third soldering zone 33 and the fourth soldering zone 34 are used for being soldered with a corresponding part of the terminal module 2, so that the terminal module 2 is located to the circuit board 3, and the terminal module 2 is fastened to the circuit board 3. Signals are transmitted between the terminal module 2 and the circuit board 3.

Figure 3:
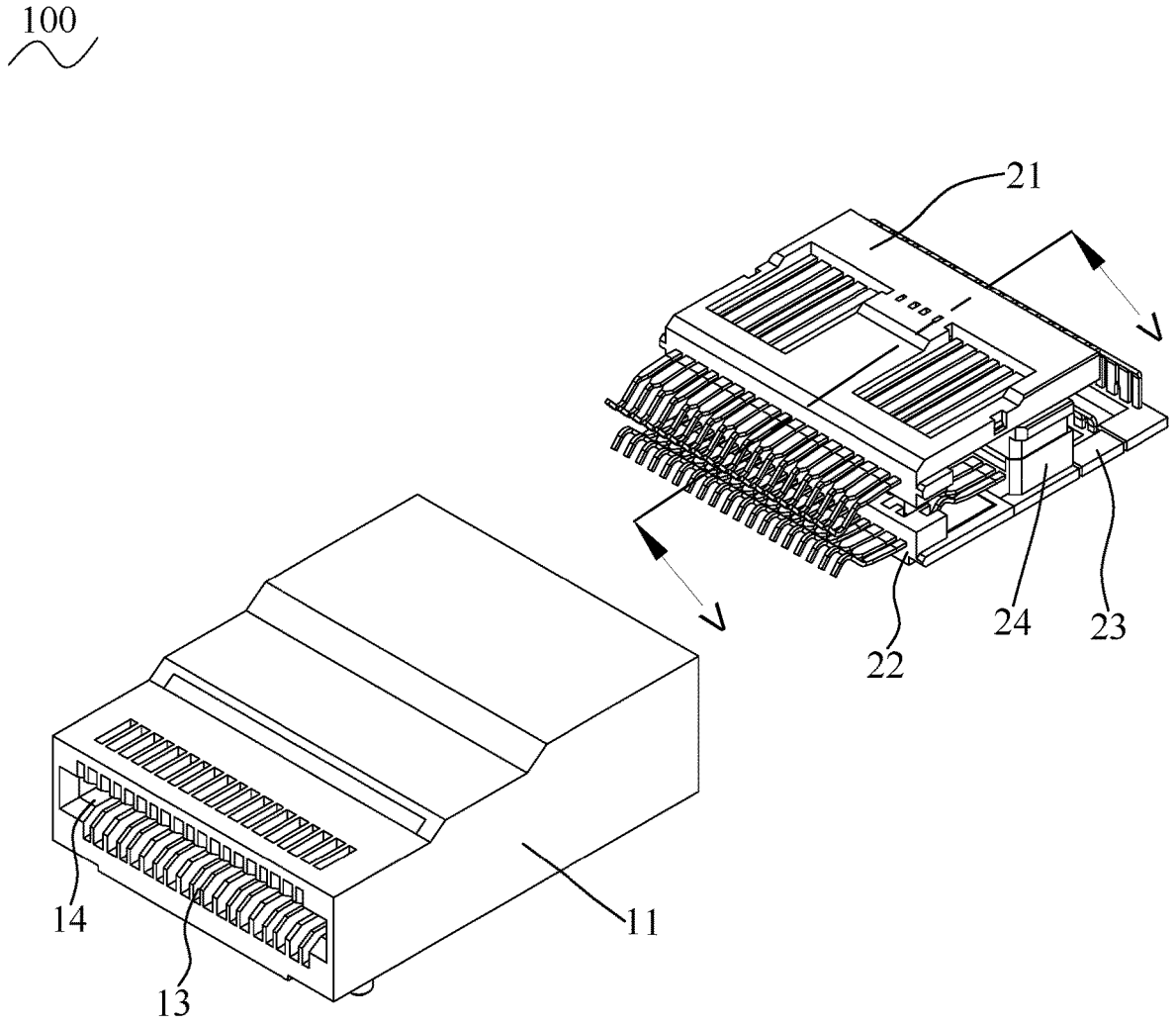
FIG. 3 is a partially exploded view of the high-speed connector of FIG. 1.
Figure 4:
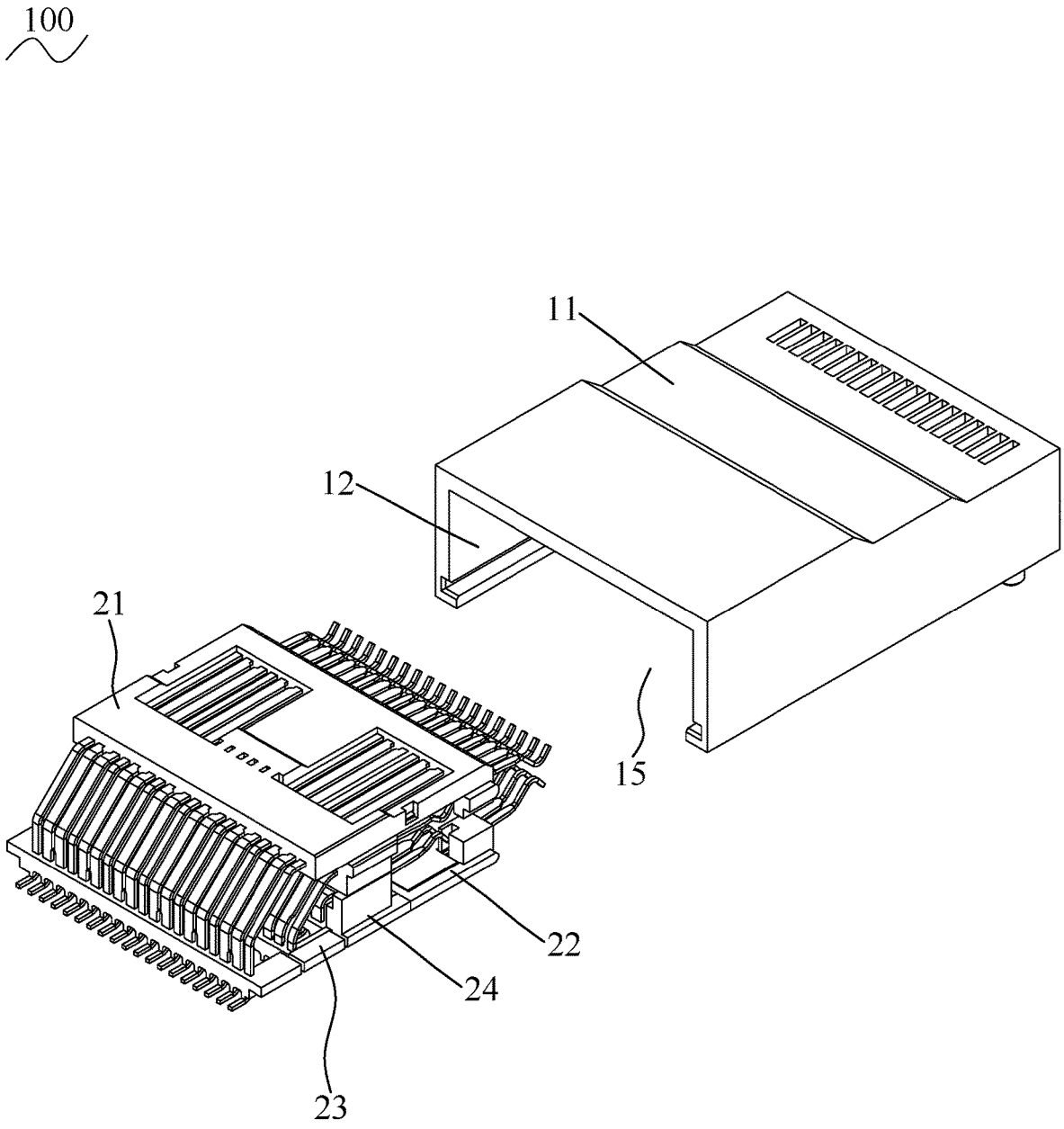
FIG. 4 is another partially exploded view of the high-speed connector of FIG. 3.

Referring to FIG. 3 and FIG. 4, the insulating housing 1 has a main portion 11, an accommodating space 12, a plurality of terminal slots 13, a penetrating groove 14 and an assembling groove 15. An inside of the main portion 11 defines the accommodating space 12. The plurality of the terminal slots 13 are arranged in two rows. The accommodating space 12 penetrates through a bottom of a rear end of the main portion 11. The penetrating groove 14 penetrates through a middle of a front end of the main portion 11 along a longitudinal direction. The penetrating groove 14 is located in front of the accommodating space 12. The penetrating groove 14 is communicated between an outside and a front end of the accommodating space 12. The rear end of the main portion 11 defines the assembling groove 15 penetrating through a rear surface of the main portion 11. The assembling groove 15 is located behind the accommodating space 12. The assembling groove 15 is communicated with the accommodating space 12.

The front end of the main portion 11 defines the plurality of the terminal slots 13 arranged in an upper row and a lower row. An upper portion and a lower portion of the front end of the main portion 11 are isolated by the penetrating groove 14. The upper portion of the main portion 11 defines the upper row of the terminal slots 13 penetrating through a front surface and a top surface of the main portion 11, a bottom surface of the upper portion of the main portion 11 and a rear surface of the upper portion of the main portion 11. The lower portion of the main portion 11 defines the lower row of the terminal slots 13 penetrating through the front surface and a bottom surface of the main portion 11, a top surface of the lower portion of the main portion 11 and a rear surface of the lower portion of the main portion 11. The upper row of the terminal slots 13 and the lower row of the terminal slots 13 are communicated with an upper portion and a lower portion of the accommodating space 12, respectively. The two rows of the terminal slots 13 are connected with the front end of the accommodating space 12. The penetrating groove 14 is located between the upper row of the terminal slots 13 and the lower row of the terminal slots 13. The penetrating groove 14 is communicated with the upper row of the terminal slots 13 and the lower row of the terminal slots 13.

Figure 5:
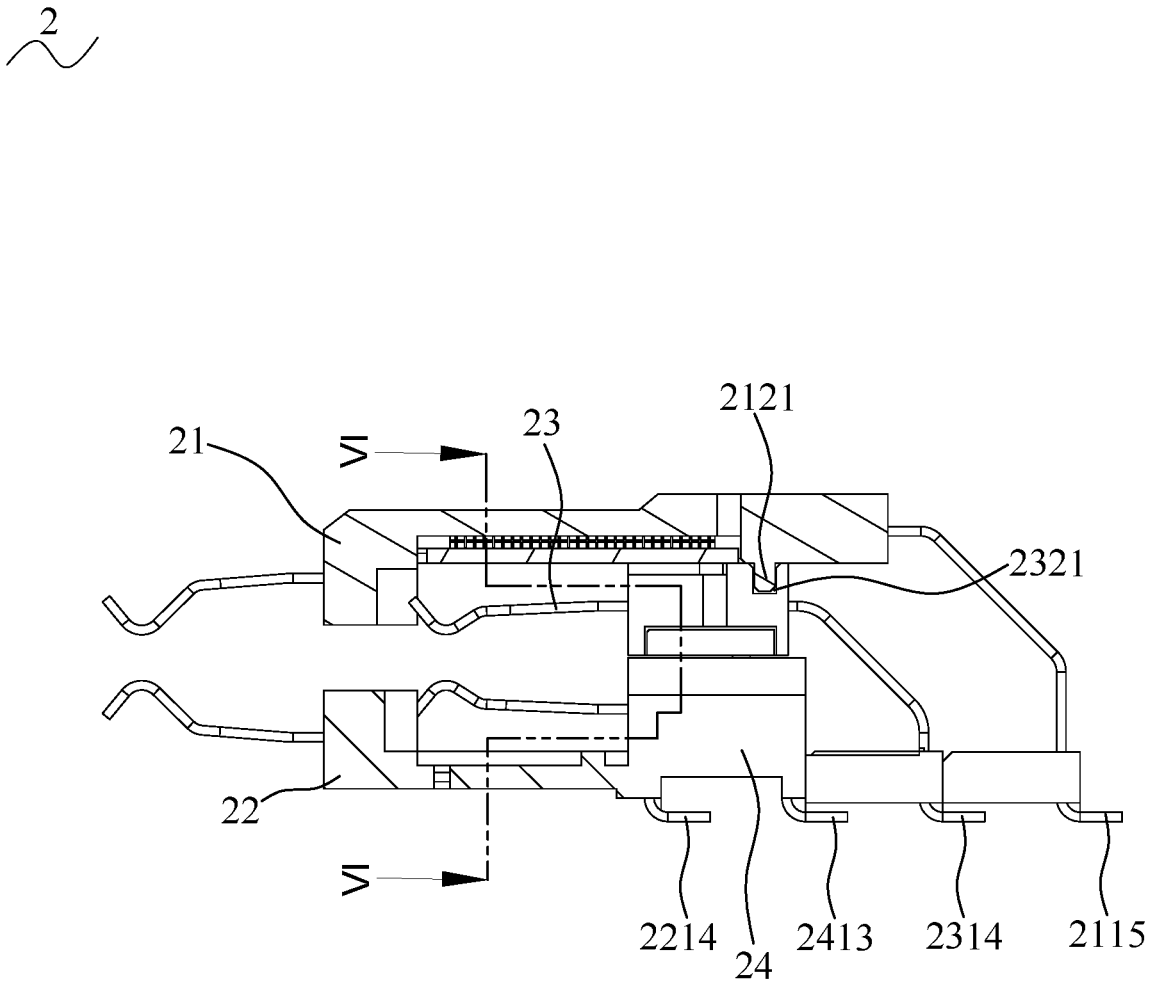
FIG. 5 is a sectional view of a terminal module of the high-speed connector along a line V-V of FIG. 3.
Figure 6:
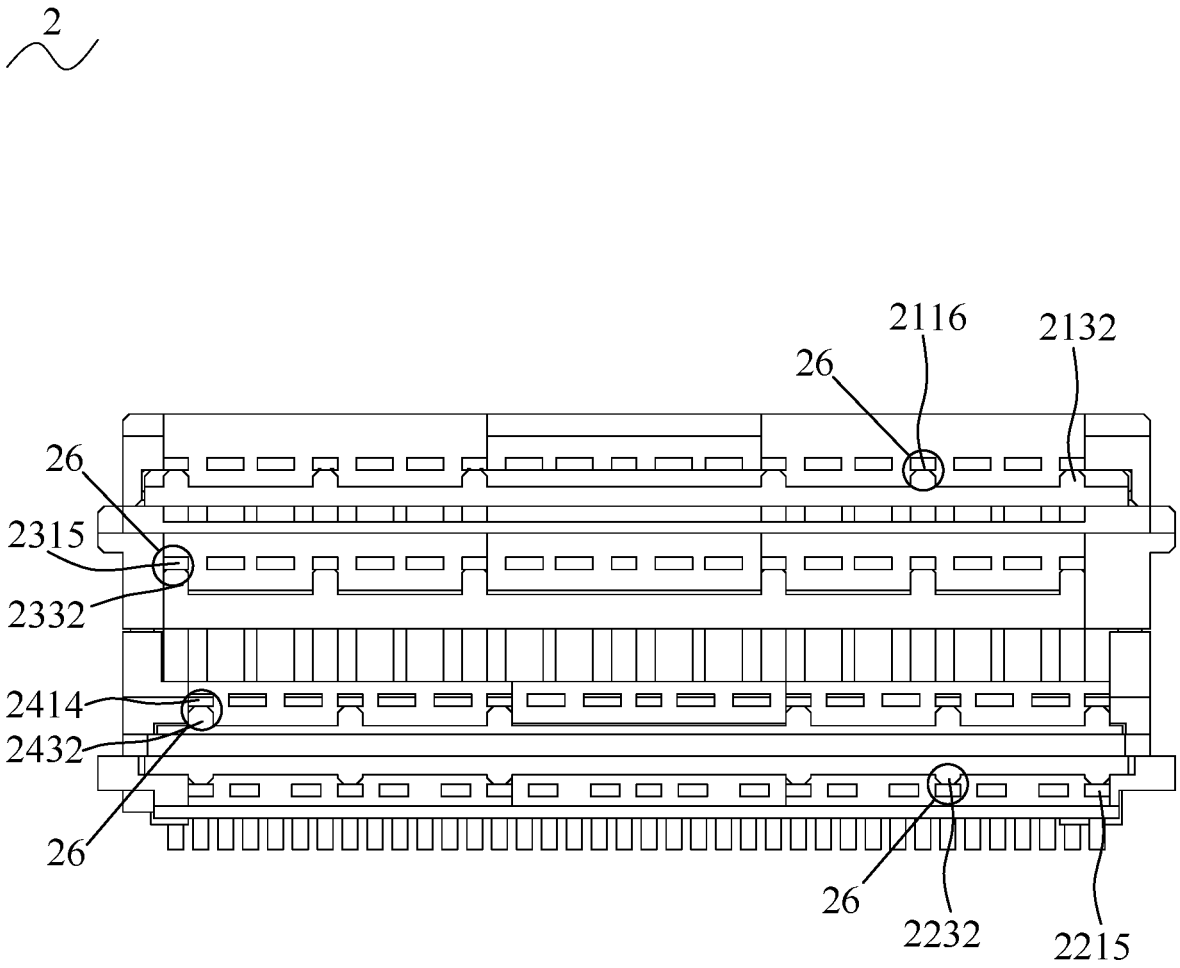
FIG. 6 is a sectional view of the terminal module of the high-speed connector along a line VI-VI of FIG. 5.
Figure 7:
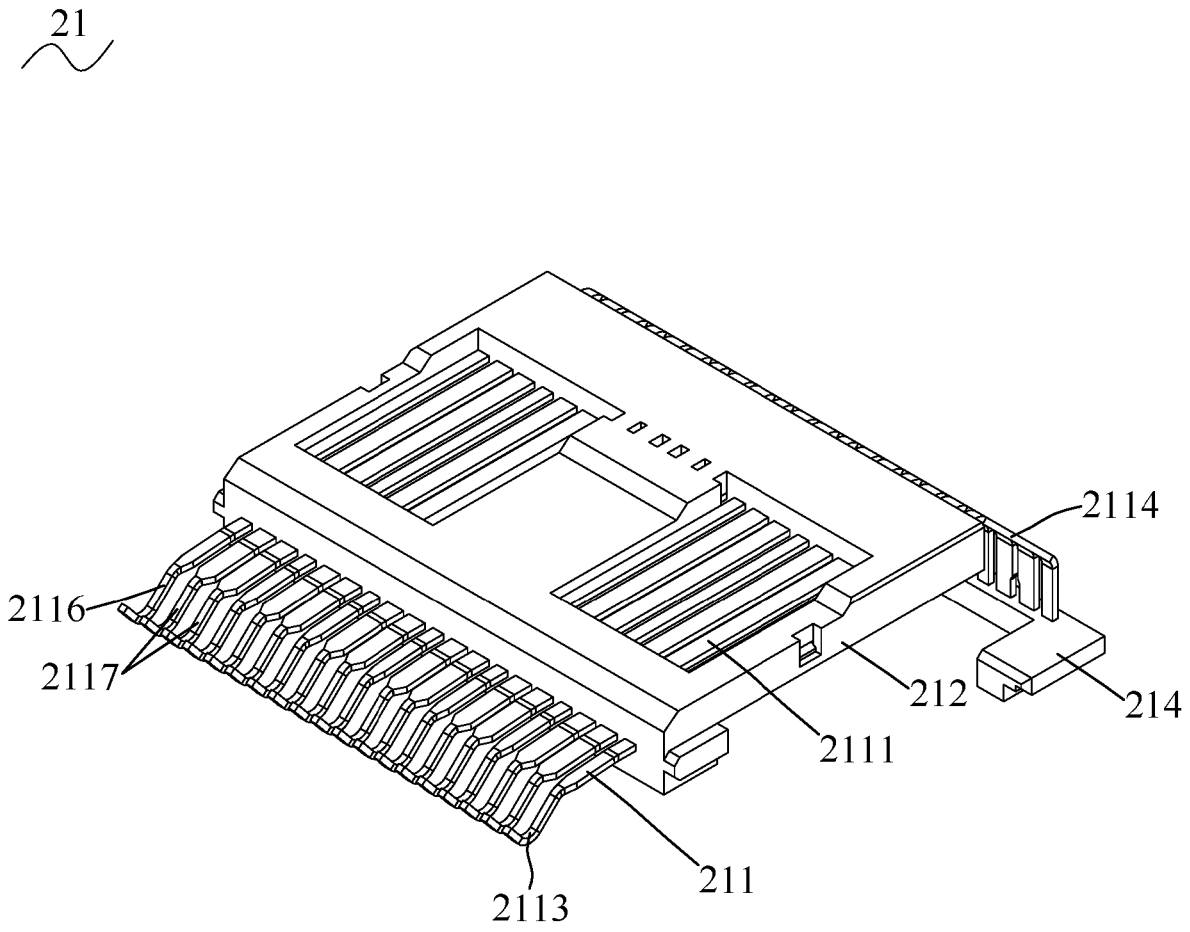
FIG. 7 is a perspective view of a first terminal assembly of the terminal module of the high-speed connector of FIG. 3.
Figure 8:
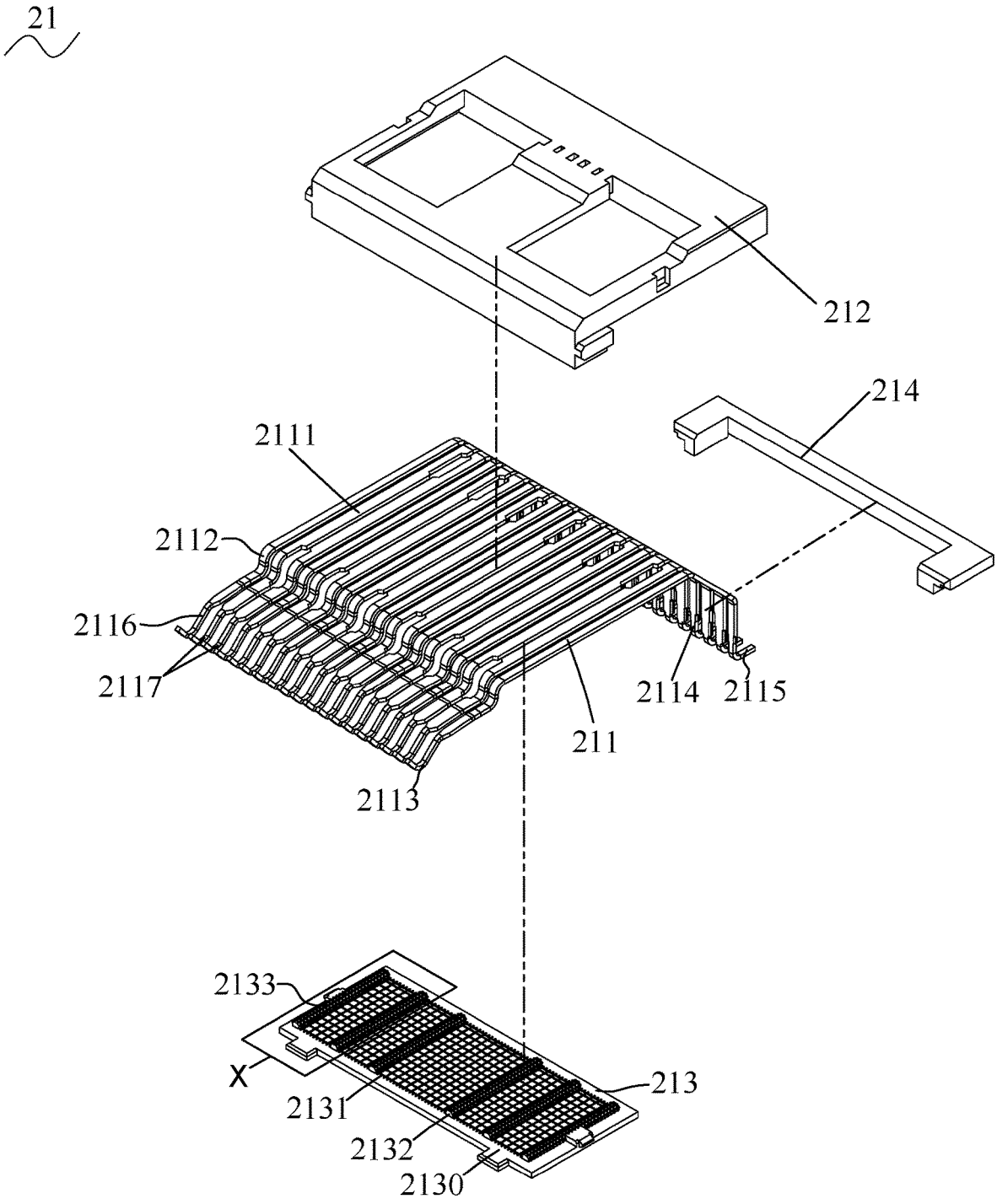
FIG. 8 is an exploded view of the first terminal assembly of the terminal module of the high-speed connector of FIG. 3.
Figure 9:
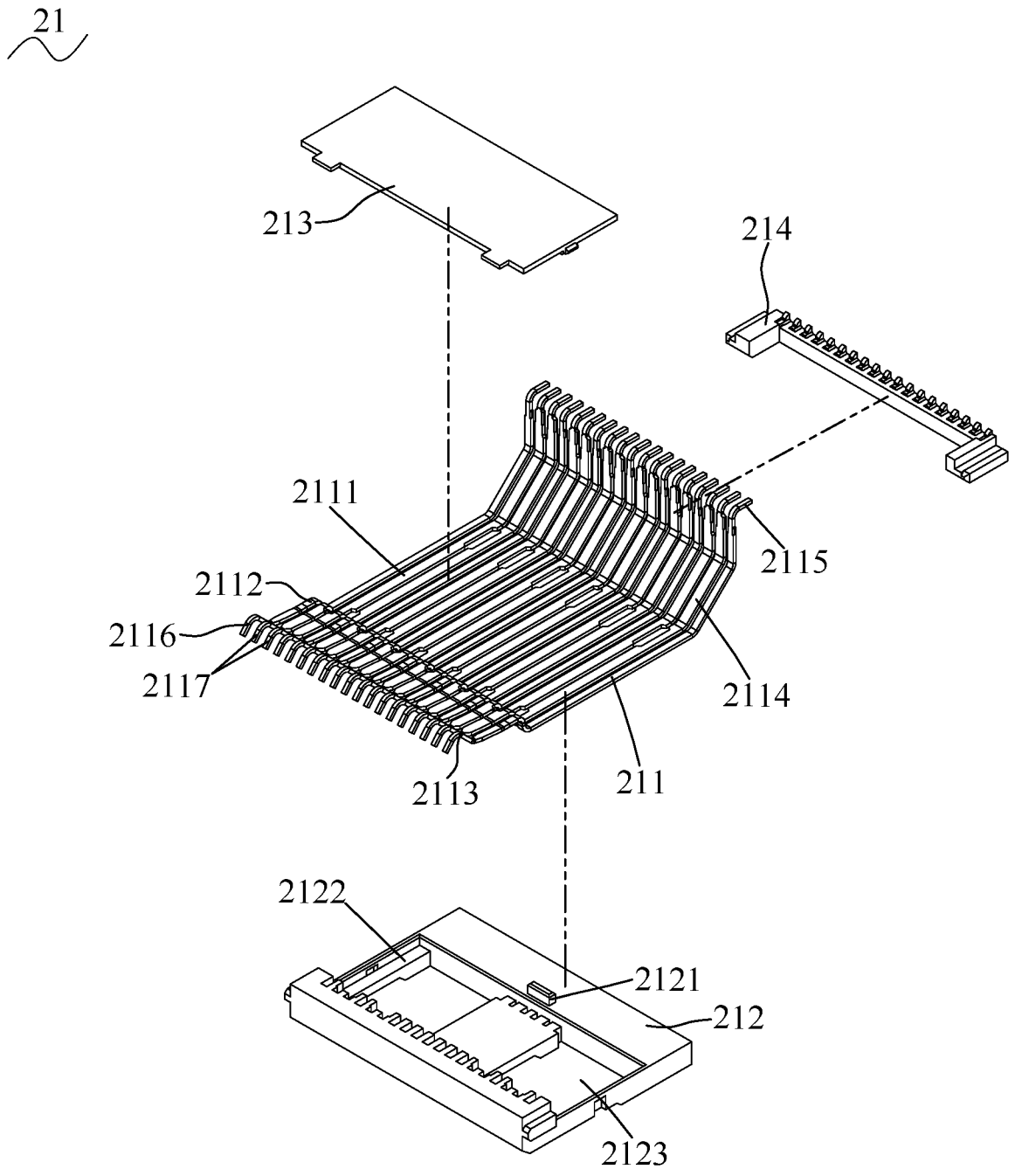
FIG. 9 is another exploded view of the first terminal assembly of the terminal module of the high-speed connector of FIG. 8.
Figure 10:
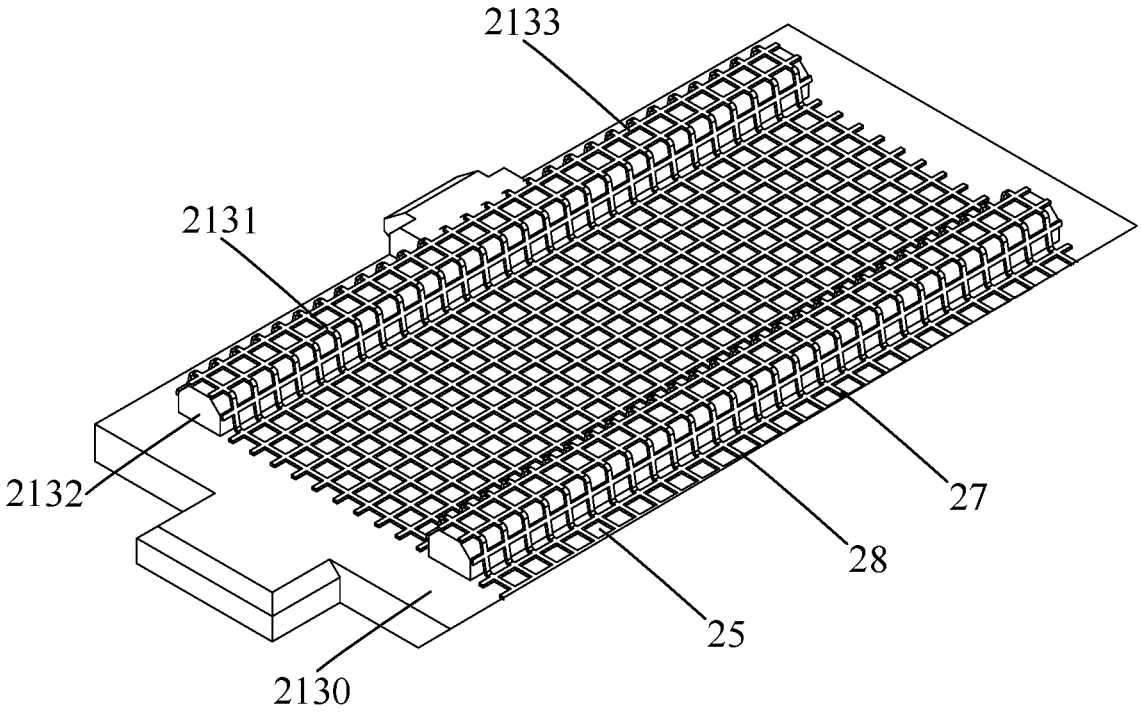
FIG. 10 is an enlarged view of an encircled portion X of the high-speed connector of FIG. 8.
Figure 11:
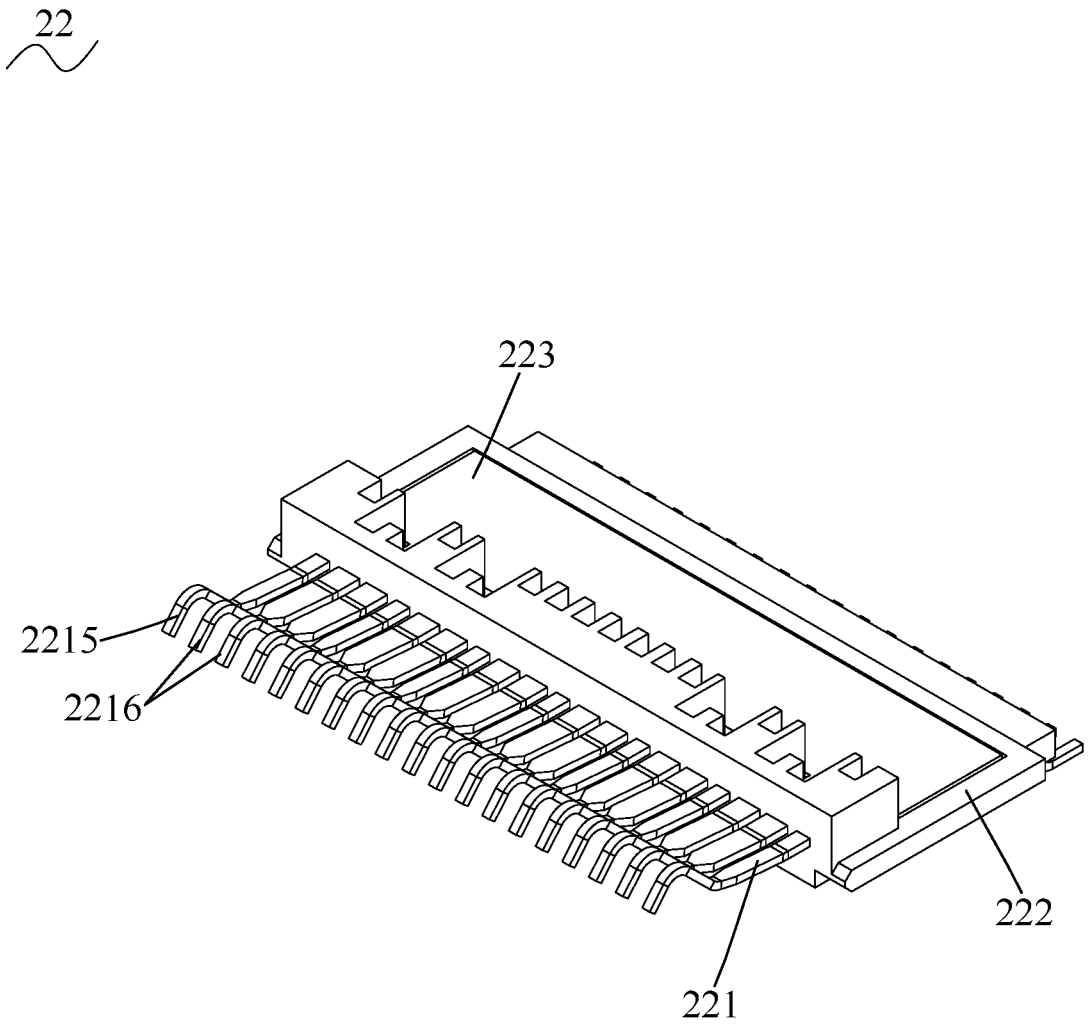
FIG. 11 is a perspective view of a second terminal assembly of the terminal module of the high-speed connector of FIG. 3.
Figure 12:
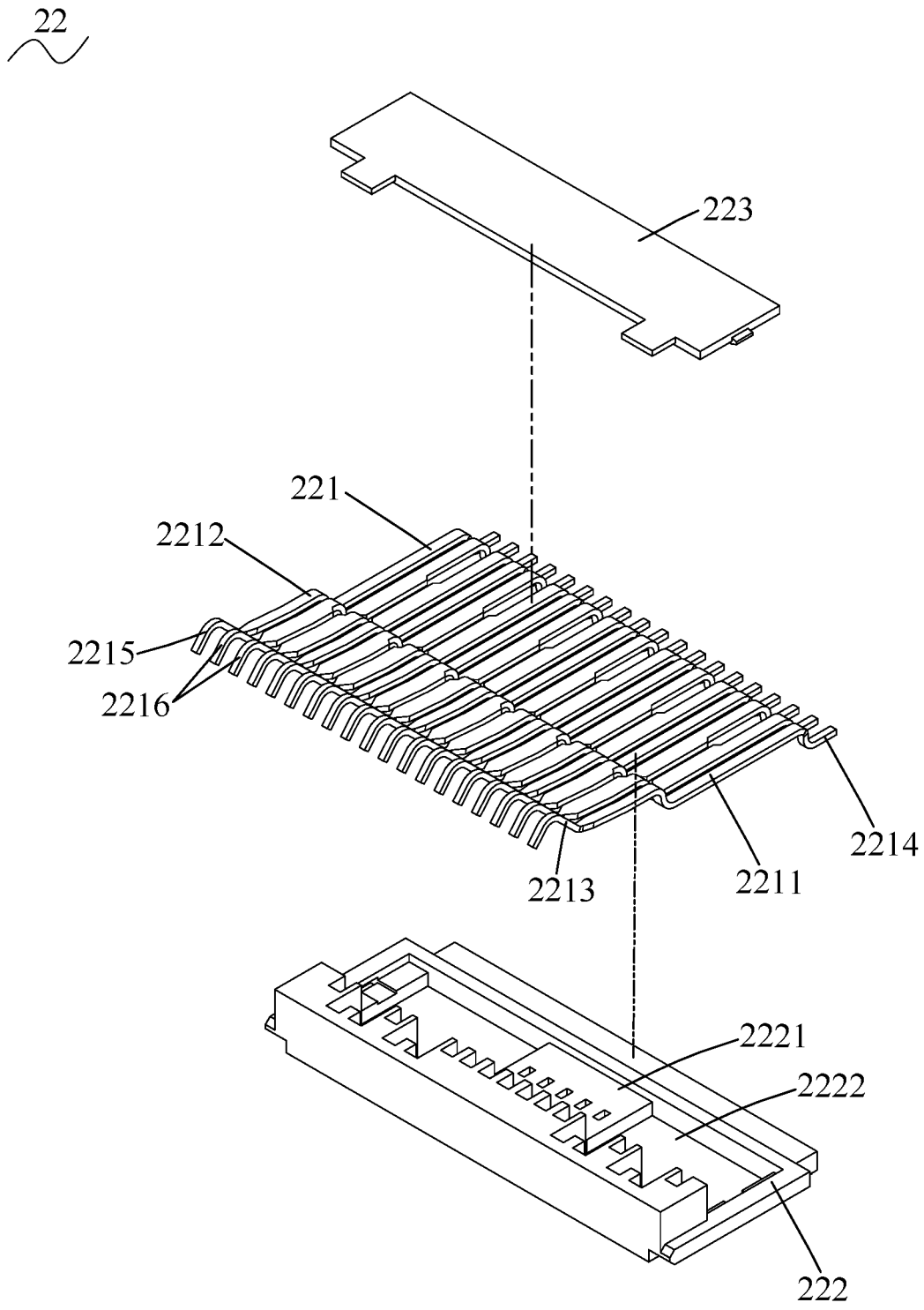
FIG. 12 is an exploded view of the second terminal assembly of the terminal module of the high-speed connector of FIG. 3.
Figure 13:
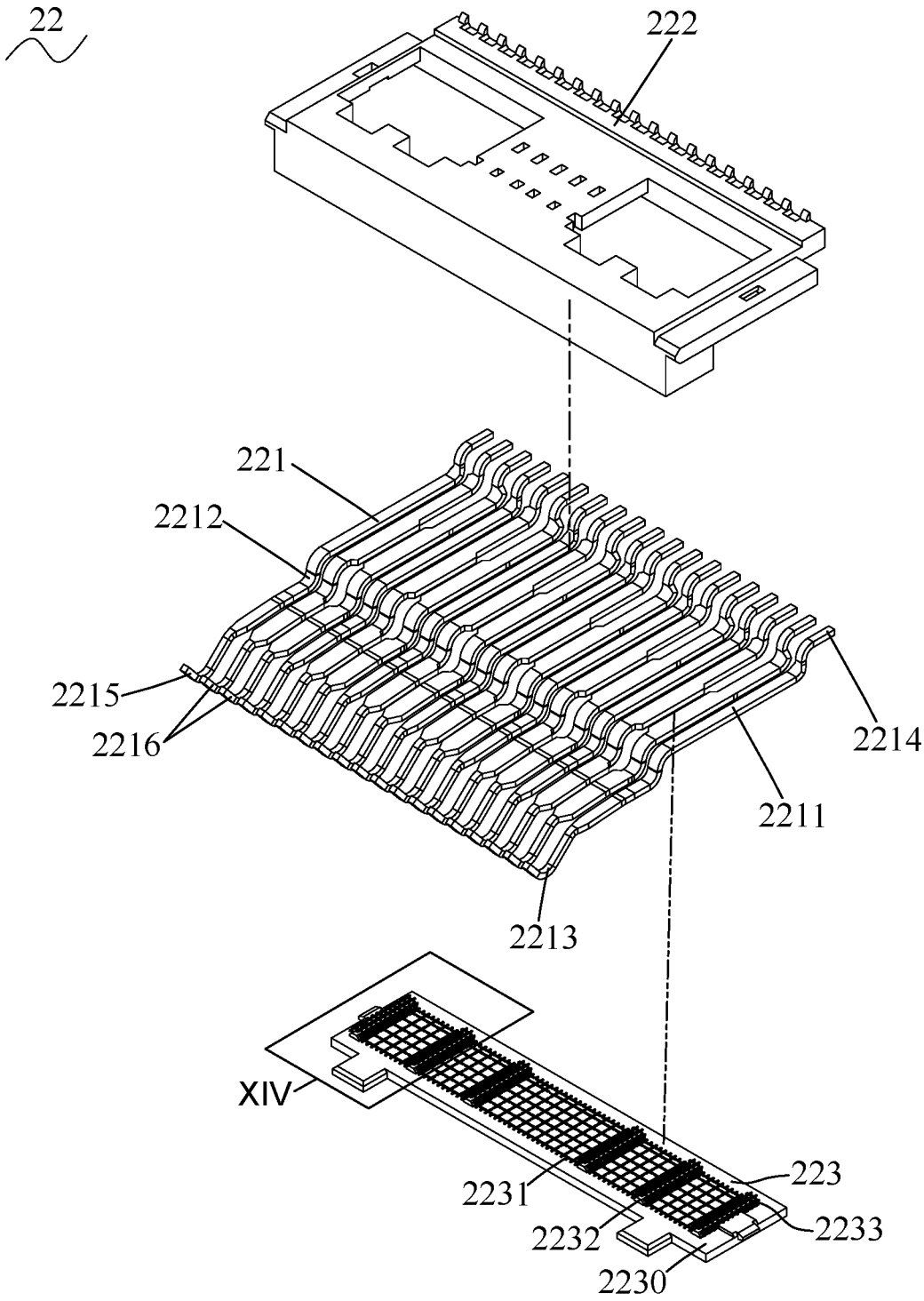
FIG. 13 is another exploded view of the second terminal assembly of the terminal module of the high-speed connector of FIG. 3.
Figure 14:
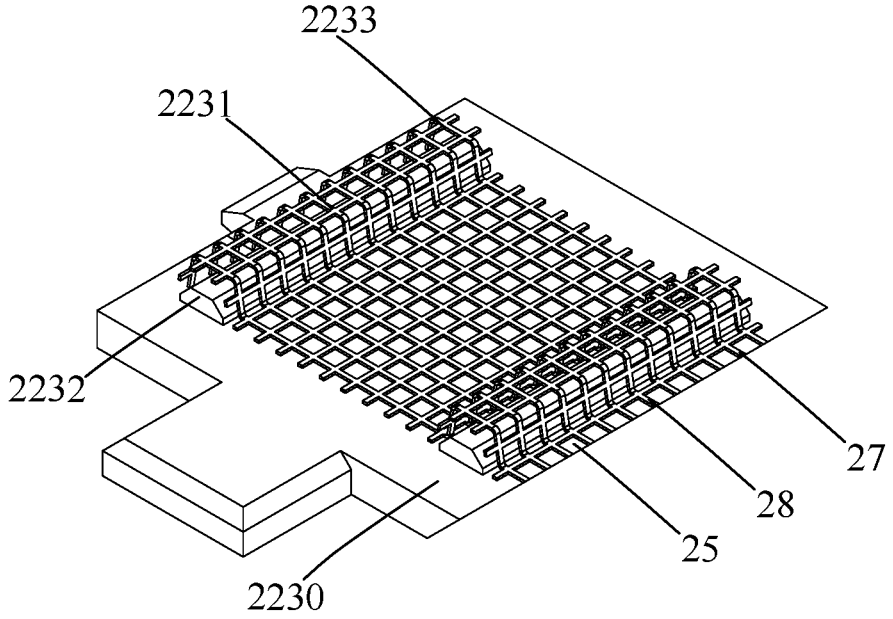
FIG. 14 is an enlarged view of an encircled portion XIV of the high-speed connector of FIG. 13.
Figure 15:
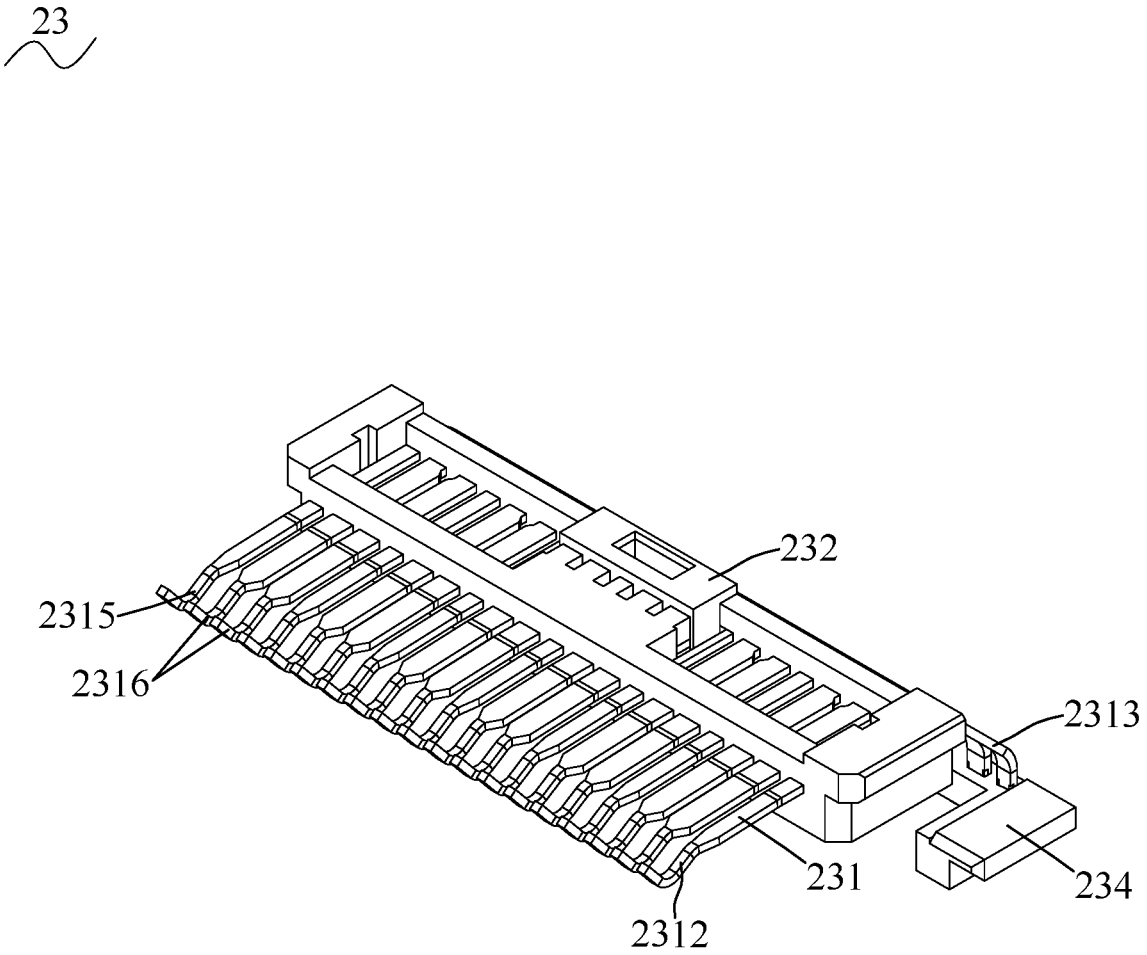
FIG. 15 is a perspective view of a third terminal assembly of the terminal module of the high-speed connector of FIG. 3.
Figure 16:
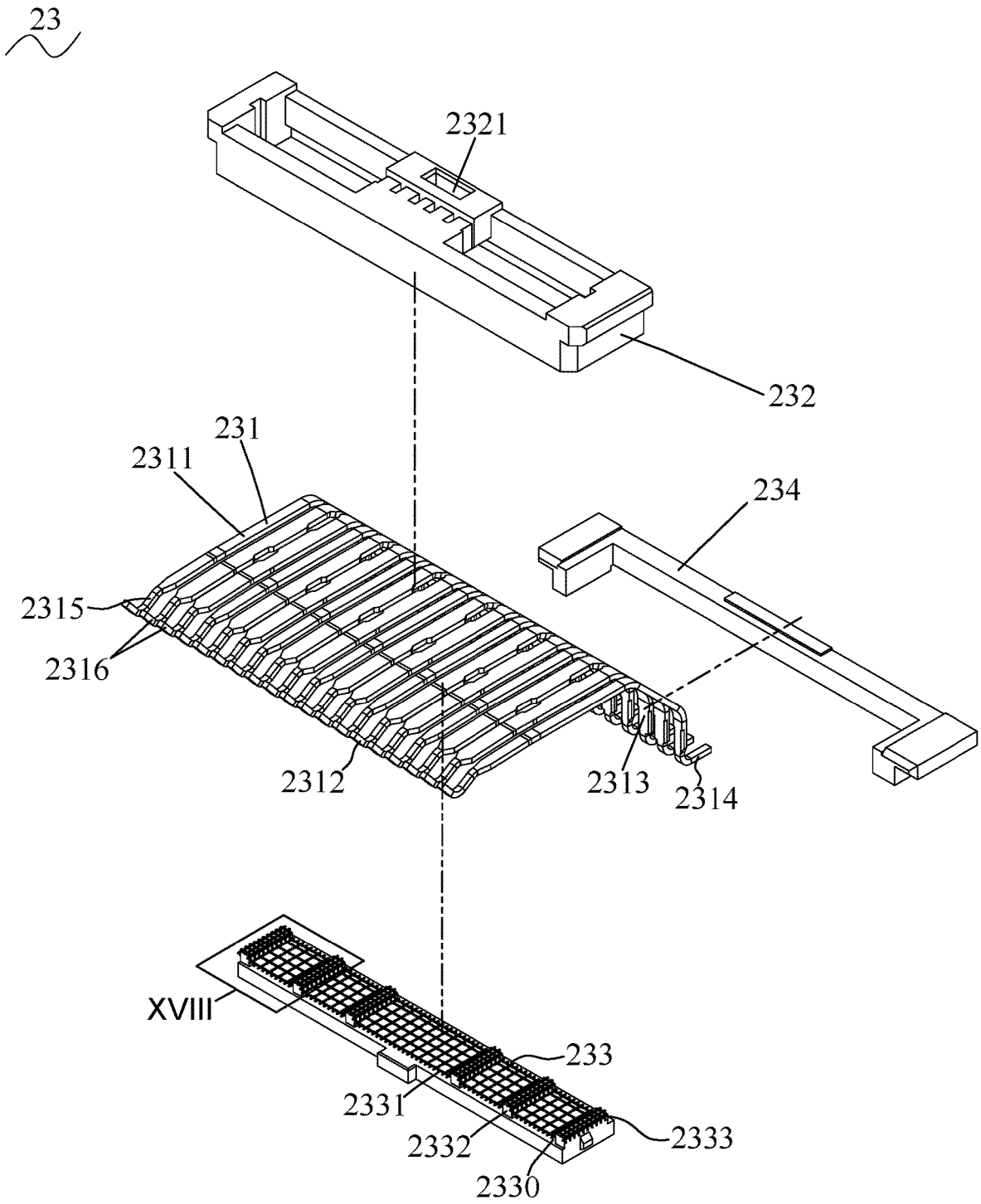
FIG. 16 is an exploded view of the third terminal assembly of the terminal module of the high-speed connector of FIG. 3.
Figure 17:
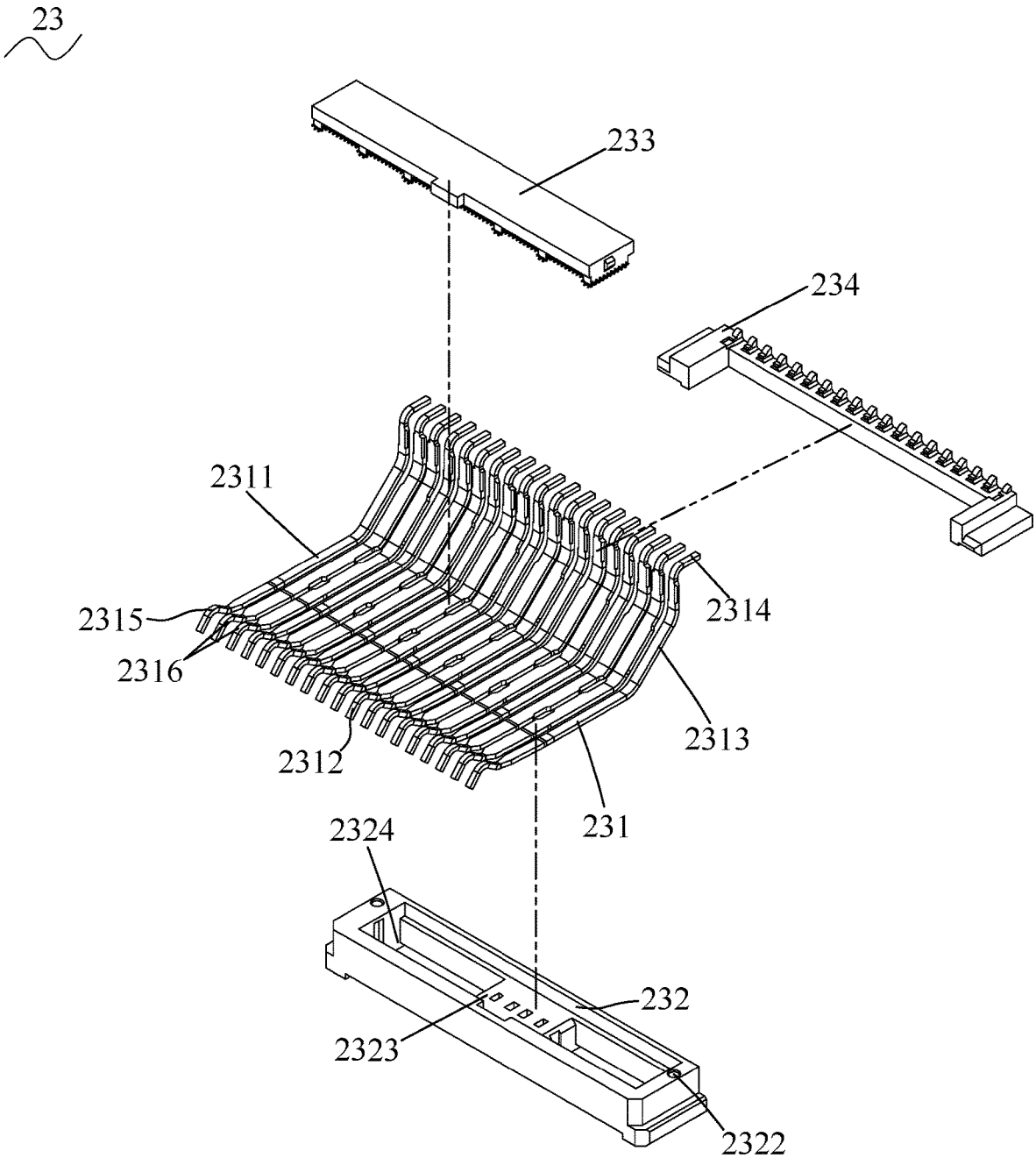
FIG. 17 is another exploded view of the third terminal assembly of the terminal module of the high-speed connector of FIG. 16.
Figure 18:
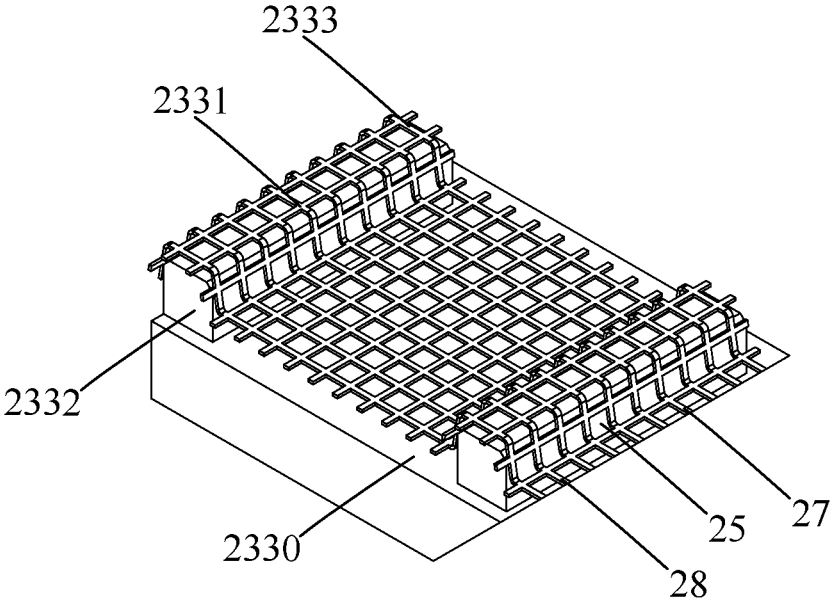
FIG. 18 is an enlarged view of an encircled portion XVIII of the high-speed connector of FIG. 16.
Figure 19:
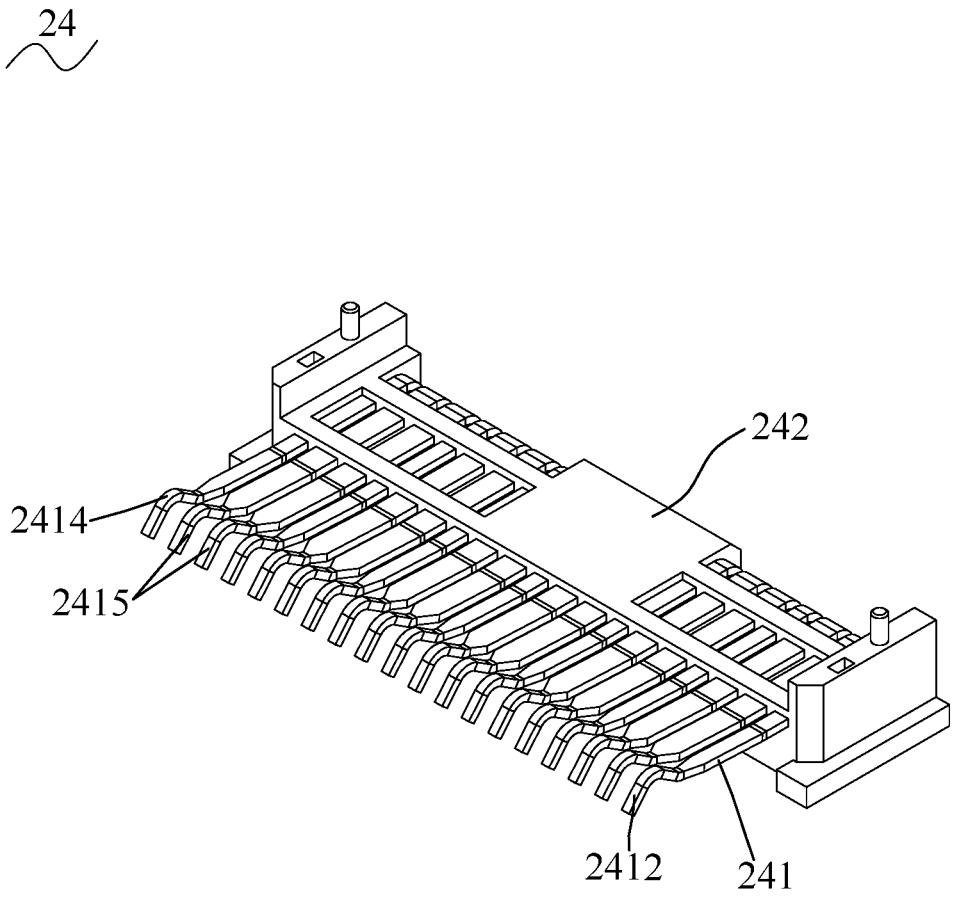
FIG. 19 is a perspective view of a fourth terminal assembly of the terminal module of the high-speed connector of FIG. 3.
Figure 20:
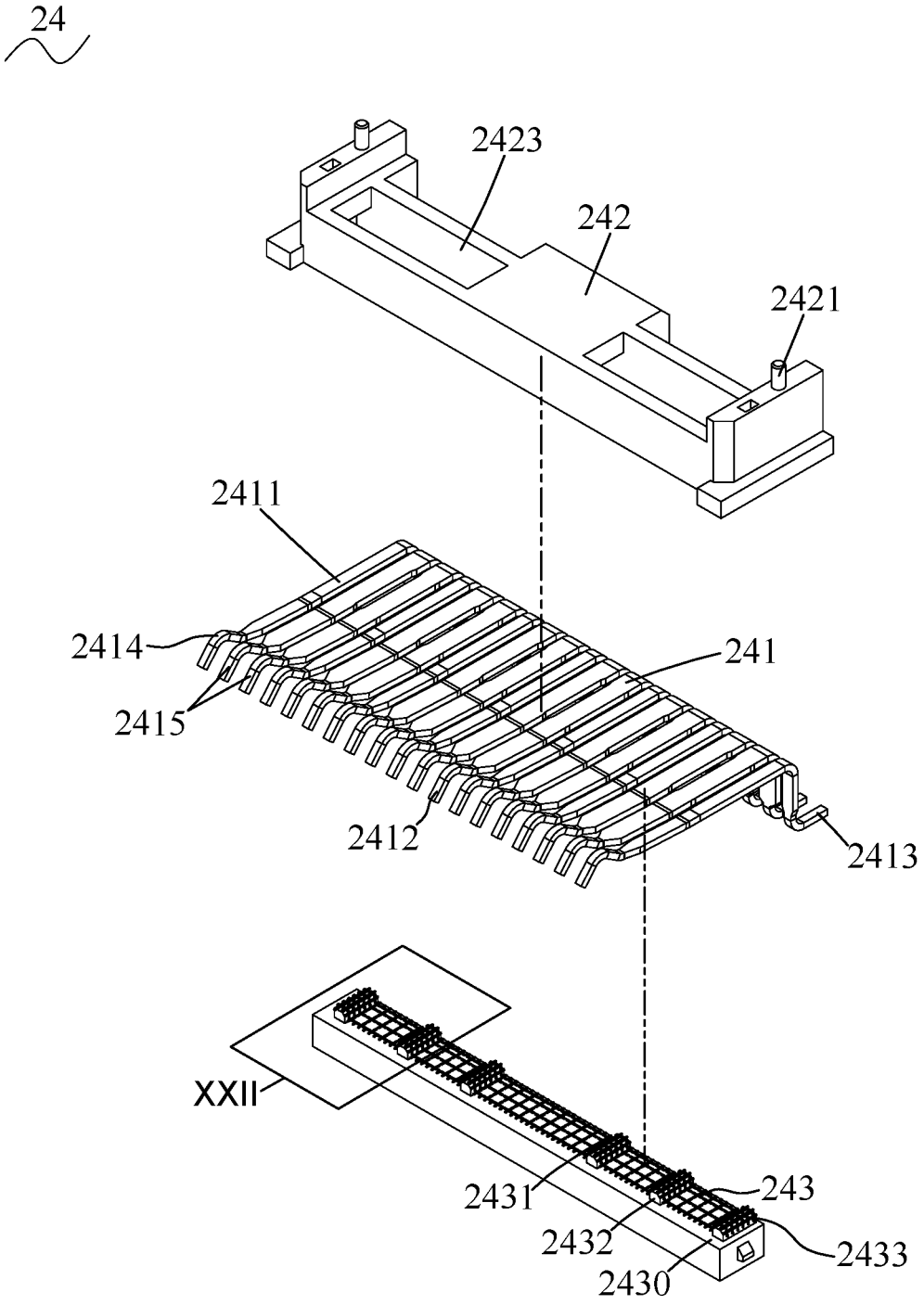
FIG. 20 is an exploded view of the fourth terminal assembly of the terminal module of the high-speed connector of FIG. 3.
Figure 21:
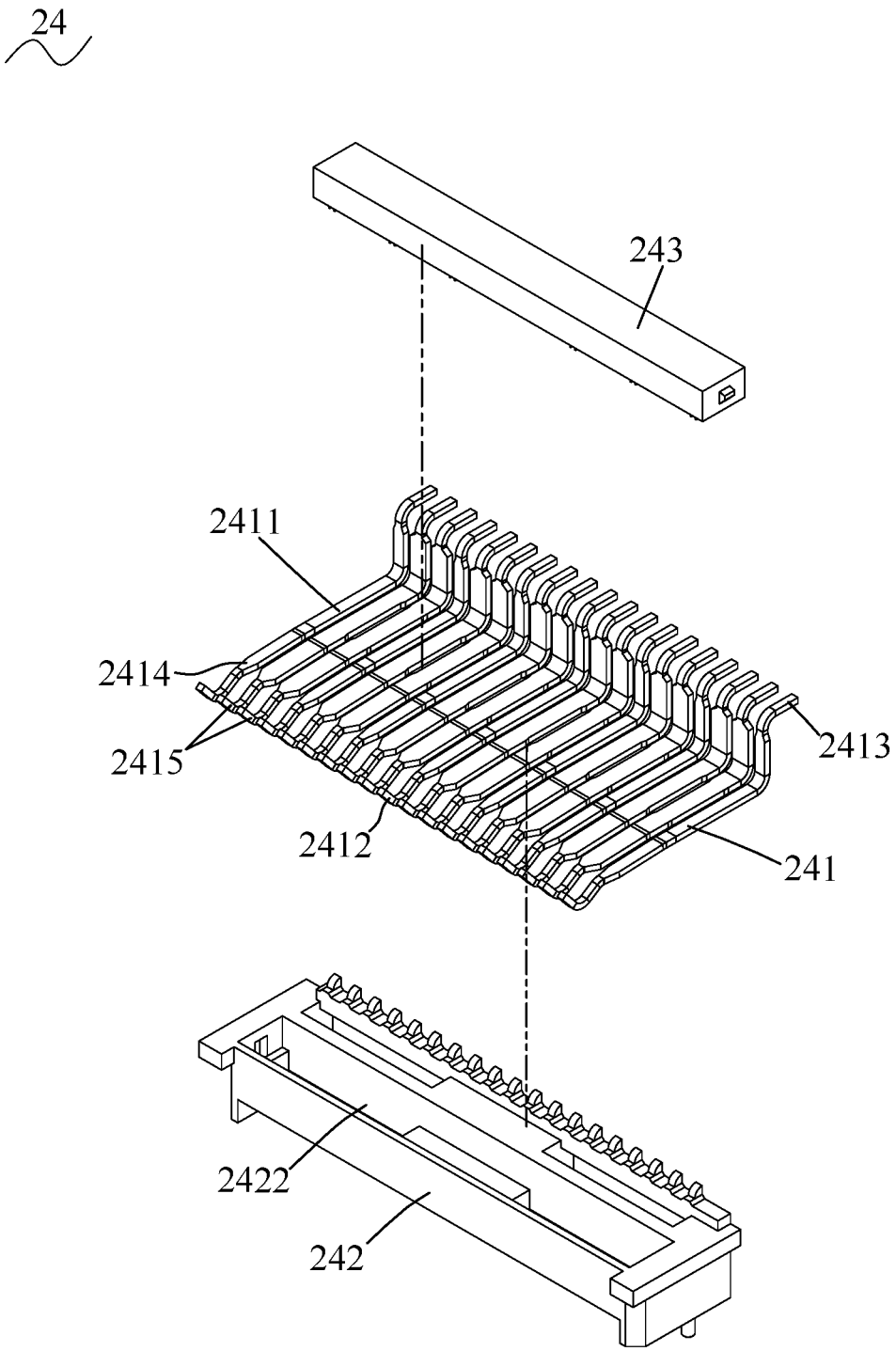
FIG. 21 is another exploded view of the fourth terminal assembly of the terminal module of the high-speed connector of FIG. 20.
Figure 22:
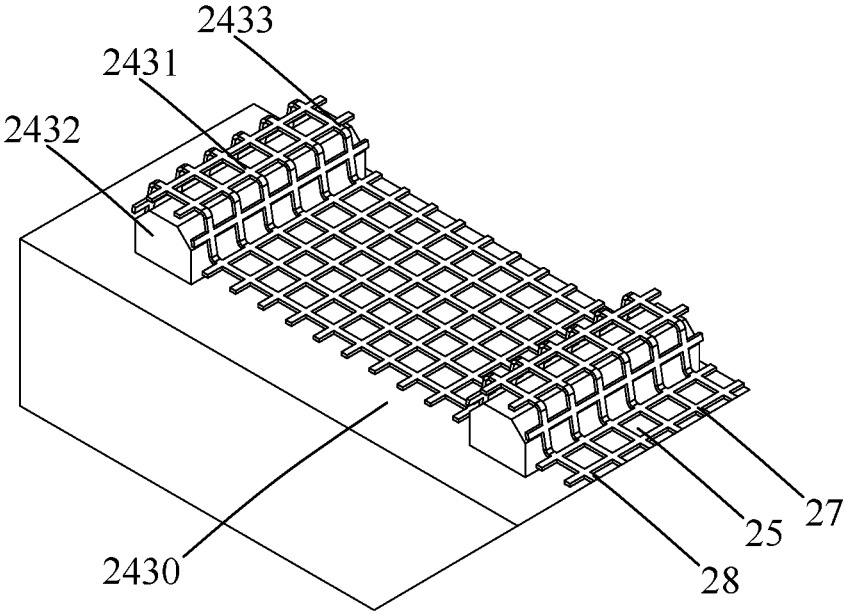
FIG. 22 is an enlarged view of an encircled portion XXII of the high-speed connector of FIG. 20.

Referring to FIG. 3 to FIG. 5, the terminal module 2 is inserted into the accommodating space 12 from the assembling groove 15 of the insulating housing 1. In the preferred embodiment, the terminal module 2 includes a first terminal assembly 21, a second terminal assembly 22, a third terminal assembly 23 and a fourth terminal assembly 24. The first terminal assembly 21, the second terminal assembly 22, the third terminal assembly 23 and the fourth terminal assembly 24 of the terminal module 2 are mounted in the insulating housing 1. In a concrete implementation, the terminal module 2 is without being limited to include the first terminal assembly 21, the second terminal assembly 22, the third terminal assembly 23 and the fourth terminal assembly 24. The first terminal assembly 21, the second terminal assembly 22, the third terminal assembly 23 and the fourth terminal assembly 24 are inserted into the accommodating space 12 from the assembling groove 15 of the insulating housing 1. The first terminal assembly 21 is corresponding to the second terminal assembly 22, and the third terminal assembly 23 is corresponding to the fourth terminal assembly 24. In the preferred embodiment, the first terminal assembly 21 and the second terminal assembly 22 form a QSFP (Quad Small Form-Factor Pluggable) terminal assembly. The third terminal assembly 23 and the fourth terminal assembly 24 form another QSFP (Quad Small Form-Factor Pluggable) terminal assembly. In practice, the high-speed connector 100 is configured with the first terminal assembly 21, the second terminal assembly 22, the third terminal assembly 23 and the fourth terminal assembly 24 to form a QSFP-DD (Quad Small Form Factor Pluggable-Double Density) high-speed connector. The high-speed connector 100 is able to be configured with the first terminal assembly 21 and the second terminal assembly 22 to form a QSFP connector. The high-speed connector 100 is also able to be configured with the third terminal assembly 23 and the fourth terminal assembly 24 to form another QSFP connector.

Referring to FIG. 6 to FIG. 10, the first terminal assembly 21 includes a plurality of first terminals 211, a first base body 212, a first shielding plate 213 and a first holding element 214. The plurality of the first terminals 211 are fastened to the first base body 212, and the plurality of the first terminals 211 are partially surrounded by the first base body 212. The first shielding plate 213 is disposed under the first base body 212. Rear ends of the plurality of the first terminals 211 are surrounded by the first holding element 214.

Each first terminal 211 has a first fastening portion 2111, a first stepping portion 2112, a first contact portion 2113, a first bending portion 2114 and a first soldering portion 2115. The plurality of the first terminals 211 include a plurality of first grounding terminals 2116 and a plurality of first signal terminals 2117. In the preferred embodiment, the plurality of the first terminals 211 includes seven first grounding terminals 2116 and twelve first signal terminals 2117. In the preferred embodiment, each two adjacent first signal terminals 2117 are located between two first grounding terminals 2116. Each first signal terminal 2117 is used for transmitting the signals.

Bottom surfaces of the plurality of the first fastening portions 2111 of the plurality of the first terminals 211 are exposed to a bottom surface of the first base body 212. A front end of the first fastening portion 2111 of each first terminal 211 is bent downward to form the first stepping portion 2112. The plurality of the first stepping portions 2112 of the plurality of the first terminals 211 are mounted in a front end of the first base body 212. A front end of the first stepping portion 2112 of each first terminal 211 extends frontward and then is arched downward to form the first contact portion 2113. The first contact portion 2113 of each first terminal 211 projects beyond a front surface of the first base body 212. The plurality of the first contact portions 2113 of the plurality of the first terminals 211 are disposed in front ends of the upper row of the terminal slots 13. Bottom surfaces of the plurality of the first contact portions 2113 of the plurality of the first terminals 211 are exposed out of bottoms of the upper row of the terminal slots 13 and project into the penetrating groove 14. A rear end of the first fastening portion 2111 of each first terminal 211 extends rearward, then slantwise extends downward and rearward, and further extends downward to form the first bending portion 2114. The first bending portion 2114 of each first terminal 211 projects beyond a rear surface of the first base body 212. Tail ends of the plurality of the first bending portions 2114 of the plurality of the first terminals 211 are surrounded by the first holding element 214. The tail end of the first bending portion 2114 of each first terminal 211 is bent rearward and extends rearward to form the first soldering portion 2115. The plurality of the first soldering portions 2115 of the plurality of the first terminals 211 are soldered to the first soldering zone 31 of the circuit board 3.

The first base body 212 surrounds rear ends of the plurality of the first fastening portions 2111 and the plurality of the first stepping portions 2112 of the plurality of the first terminals 211. The first holding element 214 surrounds lower ends of the first bending portions 2114 of the plurality of the first terminals 211. The first base body 212 has a protrusion 2121, a first fastening groove 2122 and at least two first perforations 2123. In the preferred embodiment, the first base body 212 includes the protrusion 2121, the first fastening groove 2122, and two first perforations 2123. A rear end of the bottom surface of the first base body 212 extends downward to form the protrusion 2121. The protrusion 2121 is used for being fastened to a corresponding structure of the third terminal assembly 23 to realize that the first terminal assembly 21 is located to the third terminal assembly 23 and that the first terminal assembly 21 is fixed to the third terminal assembly 23. A middle of the bottom surface of the first base body 212 is recessed upward to form the first fastening groove 2122. The first shielding plate 213 is disposed in the first fastening groove 2122 of the first base body 212. Two sides of the first base body 212 define the at least two first perforations 2123 penetrating through a top surface and the bottom surface of the first base body 212. The plurality of the first fastening portions 2111 of the plurality of the first grounding terminals 2116 and the plurality of the first fastening portions 2111 of the plurality of the first signal terminals 2117 are partially exposed to the at least two first perforations 2123. In the preferred embodiment, the two sides of the first base body 212 define the two first perforations 2123 penetrating through the top surface and the bottom surface of the first base body 212. The plurality of the first fastening portions 2111 of the plurality of the first grounding terminals 2116 and the plurality of the first fastening portions 2111 of the plurality of the first signal terminals 2117 are partially exposed to the two first perforations 2123. The first fastening portions 2111 of six first grounding terminals 2116 are exposed to the two first perforations 2123 of the two sides of the first base body 212. The first fastening portion 2111 of a middle first grounding terminal 2116 is surrounded by a middle of the first base body 212.

The first shielding plate 213 has a first base plate 2130, a first metal layer 2131 and a plurality of first ribs 2132. Several portions of an upper surface of the first shielding plate 213 protrude upward to form the plurality of the first ribs 2132. The first metal layer 2131 is disposed on a top surface of the first base plate 2130 and top surfaces of the plurality of the first ribs 2132. Several portions of the top surface of the first base plate 2130 of the first shielding plate 213 extend upward to form the plurality of the first ribs 2132. In the concrete implementation, the first metal layer 2131 is formed on the top surface of the first base plate 2130 and the top surfaces of the plurality of the first ribs 2132 by an electroplating technology and a laser engraving technology etc. The first metal layer 2131 is formed on the top surface of the first base plate 2130 and the top surfaces of the plurality of the first ribs 2132 by an evaporation technology.

In the preferred embodiment, the first metal layer 2131 is designed to be a pattern 28 with a plurality of pores 25, and the plurality of the pores 25 of the pattern 28 of the first metal layer 2131 are the same shape. The pattern 28 of the first metal layer 2131 is without being limited to the shape in accordance with the preferred embodiment. In the concrete implementation, the plurality of the pores 25 of the pattern 28 of the first metal layer 2131 are different shapes. The plurality of the pores 25 are formed by a plurality of interlaced lines 27. The plurality of the interlaced lines 27 are extended on the top surface of the first base plate 2130 and the top surfaces of the plurality of the first ribs 2132, so the signals partially penetrate through the plurality of the pores 25 of the first metal layer 2131, and the signals are partially reflected by the first metal layer 2131.

In the preferred embodiment, each pore 25 is shown as a square shape. In the concrete implementation, each pore 25 is any shape, and the pattern 28 is any shape. The pattern 28 is able to be composed by at least two groups of the pores 25, and the plurality of the pores 25 of the at least two groups are different. When the pattern 28 is composed by two groups of the pores 25, each pore 25 of the one group is shown as the square shape, and each pore 25 of the other group is shown as an L shape.

In the preferred embodiment, the pattern 28 of the first metal layer 2131 is capable of reducing a resonance point in a high frequency characteristic of the high-speed connector 100, so an oscillation is reduced to improve the high frequency characteristic of the high-speed connector 100. The high-speed connector 100 is capable of improving a far-end crosstalk, a near-end crosstalk, an insertion loss and a return loss, so performances of the far-end crosstalk, the near-end crosstalk, the insertion loss and the return loss are better.

In the preferred embodiment, a quantity of the plurality of the first ribs 2132 is six. Several of the first grounding terminals 2116 are corresponding to the plurality of the first ribs 2132. Bottom surfaces of the first fastening portions 2111 of the several of the first grounding terminals 2116 contact with the first metal layer 2131 which is attached to the top surfaces of the plurality of the first ribs 2132 to form a grounding structure 26. Specifically, the bottom surfaces of the first fastening portions 2111 of the six first grounding terminals 2116 contact with six first contacting areas 2133 of the first metal layer 2131 which is attached to the top surfaces of the six first ribs 2132 to form the grounding structure 26. In this way, a signal noise is able to be effectively absorbed and suppressed for improving transmission quality of a high-frequency signal.

Referring to FIG. 5 to FIG. 14, the second terminal assembly 22 is corresponding to the first terminal assembly 21 along an up-down direction. The second terminal assembly 22 includes a plurality of second terminals 221, a second base body 222 and a second shielding plate 223. The plurality of the second terminals 221 are fastened to the second base body 222. The plurality of the second terminals 221 are partially surrounded by the second base body 222. The second shielding plate 223 is disposed on the second base body 222.

Each second terminal 221 has a second fastening portion 2211, a second stepping portion 2212, a second contact portion 2213 and a second soldering portion 2214. The plurality of the second terminals 221 include a plurality of second grounding terminals 2215 and a plurality of second signal terminals 2216. In the preferred embodiment, the plurality of the second terminals 221 include seven second grounding terminals 2215 and twelve second signal terminals 2216. In the preferred embodiment, each two adjacent second signal terminals 2216 are located between two second grounding terminals 2215. Each second signal terminal 2216 is used for transmitting the signals.

A front end of the second fastening portion 2211 of each second terminal 221 is bent upward to form the second stepping portion 2212. The second stepping portion 2212 is disposed in a front end of the second base body 222. A front end of the second stepping portion 2212 extends frontward and then is arched upward to form the second contact portion 2213. The second contact portion 2213 projects beyond a front surface of the second base body 222. The plurality of the second contact portions 2213 of the plurality of the second terminals 221 are disposed in the lower row of the terminal slots 13. Top surfaces of the plurality of the second contact portions 2213 of the plurality of the second terminals 221 are exposed out of the lower row of the terminal slots 13 and project into the penetrating groove 14. A rear end of the second fastening portion 2211 is bent downward and then extends rearward to form the second soldering portion 2214. The plurality of the second soldering portions 2214 of the plurality of the second terminals 221 are soldered to the second soldering zone 32 of the circuit board 3.

Referring to FIG. 5 to FIG. 12, in the preferred embodiment, lengths of the plurality of the first fastening portions 2111 of the plurality of the first terminals 211 are longer than lengths of the plurality of the second fastening portions 2211 of the plurality of the second terminals 221 along the longitudinal direction. Lengths of the plurality of the first stepping portions 2112 of the plurality of the first terminals 211 and lengths of the plurality of the second stepping portions 2212 of the plurality of the second terminals 221 are the same along the longitudinal direction. Lengths of the plurality of the first contact portions 2113 of the plurality of the first terminals 211 and lengths of the plurality of the second contact portions 2213 of the plurality of the second terminals 221 are the same along the longitudinal direction.

Referring to FIG. 11 to FIG. 14, the second base body 222 surrounds the plurality of the second fastening portions 2211 and the plurality of the second stepping portions 2212 of the plurality of the second terminals 221. The plurality of the second fastening portions 2211 are partially exposed out of the second base body 222. The second base body 222 has a second fastening groove 2221 and at least two second perforations 2222. In the preferred embodiment, the second base body 222 has the second fastening groove 2221 and two second perforations 2222. A middle of a top surface of the second base body 222 is recessed downward to form the second fastening groove 2221. The second shielding plate 223 is disposed in the second fastening groove 2221 of the second base body 222. The at least two second perforations 2222 penetrate through the top surface and a bottom surface of the second base body 222. The plurality of the second fastening portions 2211 of the plurality of the second grounding terminals 2215 and the plurality of the second fastening portions 2211 of the plurality of the second signal terminals 2216 are partially exposed to the at least two second perforations 2222. In the preferred embodiment, two sides of the second base body 222 define the two second perforations 2222 penetrating through the top surface and the bottom surface of the second base body 222. The plurality of the second fastening portions 2211 of the plurality of the second grounding terminals 2215 and the plurality of the second fastening portions 2211 of the plurality of the second signal terminals 2216 are partially exposed to the two second perforations 2222. The second fastening portions 2211 of six second grounding terminals 2215 are exposed to the two second perforations 2222 of the two sides of the second base body 222. The second fastening portion 2211 of a middle second grounding terminal 2215 is surrounded by a middle of the second base body 222.

Referring to FIG. 6 to FIG. 14, the second shielding plate 223 has a second base plate 2230, a second metal layer 2231 and a plurality of second ribs 2232. Several portions of a lower surface of the second shielding plate 223 protrude downward to form the plurality of the second ribs 2232. The second metal layer 2231 is disposed under a bottom surface of the second base plate 2230 and bottom surfaces of the plurality of the second ribs 2232. Several portions of the bottom surface of the second base plate 2230 of the second shielding plate 223 extend downward to form the plurality of the second ribs 2232. In the concrete implementation, the second metal layer 2231 is formed on the bottom surface of the second base plate 2230 and the bottom surfaces of the plurality of the second ribs 2232 by the electroplating technology and the laser engraving technology etc. The second metal layer 2231 is formed on the bottom surface of the second base plate 2230 and the bottom surfaces of the plurality of the second ribs 2232 by the evaporation technology.

In the preferred embodiment, the second metal layer 2231 is designed to be the pattern 28 with the plurality of the pores 25, and the plurality of the pores 25 of the pattern 28 of the second metal layer 2231 are the same shape. The pattern 28 of the second metal layer 2231 is without being limited to the shape in accordance with the preferred embodiment. In the concrete implementation, the plurality of the pores 25 of the pattern 28 of the second metal layer 2231 is able to be different shapes. The plurality of the pores 25 are formed by the plurality of the interlaced lines 27 spread on the bottom surface of the second base plate 2230 and the bottom surfaces of the plurality of the second ribs 2232, so the signals partially penetrate through the plurality of the pores 25 of the second metal layer 2231, and the signals are partially reflected by the second metal layer 2231.

In the preferred embodiment, the pattern 28 of the second metal layer 2231 is capable of reducing the resonance point in the high frequency characteristic of the high-speed connector 100, so the oscillation is reduced to improve the high frequency characteristic of the high-speed connector 100. The high-speed connector 100 is capable of improving the far-end crosstalk, the near-end crosstalk, the insertion loss and the return loss, so the performances of the far-end crosstalk, the near-end crosstalk, the insertion loss and the return loss are better.

In the preferred embodiment, each pore 25 is shown as the square shape. In the concrete implementation, each pore 25 is any shape, and the pattern 28 is any shape. The pattern 28 is able to be composed by the at least two groups of the pores 25, and the plurality of the pores 25 of the at least two groups are different. When the pattern 28 is composed by three groups of the pores 25, the three groups of the pores 25 include a first group of the pores 25, a second group of the pores 25 and a third group of the pores 25. Each pore 25 of the first group is shown as the square shape, each pore 25 of the second group is shown as an inverted T shape, and each pore 25 of the third group is shown as a cross shape.

In the preferred embodiment, the pattern 28 of the first metal layer 2131 is different from the pattern 28 of the second metal layer 2231. The pattern 28 of the first metal layer 2131 is able to be cooperated with an overall structure of the first terminal assembly 21 to be designed. The pattern 28 of the second metal layer 2231 is able to be cooperated with an overall structure of the second terminal assembly 22 to be designed.

In the preferred embodiment, a quantity of the plurality of the second ribs 2232 is six. Several of the second grounding terminals 2215 are corresponding to the plurality of the second ribs 2232. Top surfaces of the second fastening portions 2211 of the several of the second grounding terminals 2215 contact with the second metal layer 2231 which is attached to the bottom surfaces of the plurality of the second ribs 2232 to form the grounding structure 26. Specifically, the top surfaces of the second fastening portions 2211 of the six second grounding terminals 2215 contact with six second contacting areas 2233 of the second metal layer 2231 which is attached to the bottom surfaces of the six second ribs 2232 to form the grounding structure 26. In this way, the signal noise is able to be effectively absorbed and suppressed for improving the transmission quality of the high-frequency signal.

Referring to FIG. 3, FIG. 5, FIG. 15, FIG. 16, FIG. 17 and FIG. 18, the third terminal assembly 23 is corresponding to the first terminal assembly 21 and the fourth terminal assembly 24. The third terminal assembly 23 includes a plurality of third terminals 231, a third base body 232, a third shielding plate 233 and a second holding element 234. The plurality of the third terminals 231 are fastened to the third base body 232. The plurality of the third terminals 231 are partially surrounded by the third base body 232. The third shielding plate 233 is disposed under the third base body 232. Rear ends of the plurality of the third terminals 231 are surrounded by the second holding element 234.

Each third terminal 231 has a third fastening portion 2311, a third contact portion 2312, a second bending portion 2313 and a third soldering portion 2314. The plurality of the third terminals 231 include a plurality of third grounding terminals 2315 and a plurality of third signal terminals 2316. In the preferred embodiment, the plurality of the third terminals 231 includes seven third grounding terminals 2315 and twelve third signal terminals 2316. Each two adjacent third signal terminals 2316 are located between two third grounding terminals 2315. Each third signal terminal 2316 is used for transmitting the signals.

A front end of the third fastening portion 2311 extends frontward and then is arched downward to form the third contact portion 2312. The third contact portion 2312 projects beyond a front surface of the third base body 232. A rear end of the third fastening portion 2311 extends rearward, then slantwise extends downward and rearward, and further extends downward to form the second bending portion 2313. The second bending portion 2313 projects beyond a rear surface of the third base body 232. Tail ends of the plurality of the second bending portions 2313 are surrounded by the second holding element 234. The tail end of the second bending portions 2313 is bent rearward to form the third soldering portion 2314. The plurality of the third soldering portions 2314 are soldered to the third soldering zone 33 of the circuit board 3.

The plurality of the third fastening portions 2311 of the plurality of the third terminals 231 are fastened to the third base body 232. The third base body 232 has an indentation 2321, at least one location hole 2322, a third fastening groove 2323 and at least two third perforations 2324. In the preferred embodiment, the third base body 232 has the indentation 2321, two location holes 2322, the third fastening groove 2323 and two third perforations 2324. A middle of a rear end of a top surface of the third base body 232 is recessed inward to form the indentation 2321. The protrusion 2121 of the first base body 212 of the first terminal assembly 21 is fastened to the indentation 2321 of the third terminal assembly 23 to realize that the first terminal assembly 21 is located to the third terminal assembly 23 and that the first terminal assembly 21 is fastened to the third terminal assembly 23.

At least one side of a bottom surface of the third base body 232 is recessed inward to form the at least one location hole 2322. Specifically, two sides of the bottom surface of the third base body 232 are recessed inward to form the two location holes 2322. The at least one location hole 2322 of the third terminal assembly 23 is used for being fastened to a corresponding position of the fourth terminal assembly 24 to realize that the third terminal assembly 23 is located to the fourth terminal assembly 24 and that the third terminal assembly 23 is fastened to the fourth terminal assembly 24. A middle of the bottom surface of the third base body 232 is recessed inward to form the third fastening groove 2323. The third shielding plate 233 is disposed in the third fastening groove 2323 of the third base body 232. The at least two third perforations 2324 penetrate through the top surface and the bottom surface of the third base body 232. The plurality of the third fastening portions 2311 of the plurality of the third grounding terminals 2315 and the plurality of the third fastening portions 2311 of the plurality of the third signal terminals 2316 are partially exposed to the at least two third perforations 2324. In the preferred embodiment, two sides of the third base body 232 define the two third perforations 2324 penetrating through the top surface and the bottom surface of the third base body 232. The plurality of the third fastening portions 2311 of the plurality of the third grounding terminals 2315 and the plurality of the third fastening portions 2311 of the plurality of the third signal terminals 2316 are partially exposed to the two third perforations 2324. The third fastening portions 2311 of six third grounding terminals 2315 are exposed to the two third perforations 2324 of the two sides of the third base body 232. The third fastening portion 2311 of a middle third grounding terminal 2315 is surrounded by a middle of the third base body 232.

The third shielding plate 233 has a third base plate 2330, a third metal layer 2331 and a plurality of third ribs 2332. Several portions of an upper surface of the third shielding plate 233 protrude upward to form the plurality of the third ribs 2332. The third metal layer 2331 is disposed on a top surface of the third base plate 2330 and top surfaces of the plurality of the third ribs 2332. Several portions of the top surface of the third base plate 2330 of the third shielding plate 233 extend upward to form the plurality of the third ribs 2332. In the concrete implementation, the third metal layer 2331 is formed on the top surface of the third base plate 2330 and the top surfaces of the plurality of the third ribs 2332 by the electroplating technology and the laser engraving technology etc. The third metal layer 2331 is formed on the top surface of the third base plate 2330 and the top surfaces of the plurality of the third ribs 2332 by the evaporation technology.

In the preferred embodiment, the third metal layer 2331 is designed to be the pattern 28 with the plurality of the pores 25, and the plurality of the pores 25 of the pattern 28 of the third metal layer 2331 are the same shape. The pattern 28 of the third metal layer 2331 is without being limited to the shape in accordance with the preferred embodiment. In the concrete implementation, the plurality of the pores 25 of the pattern 28 of the third metal layer 2331 is able to be different shapes. The plurality of the pores 25 are formed by the plurality of the interlaced lines 27 spread on the top surface of the third base plate 2330 and the top surfaces of the plurality of the third ribs 2332, so the signals partially penetrate through the plurality of the pores 25 of the third metal layer 2331, and the signals are partially reflected by the third metal layer 2331.

In the preferred embodiment, the pattern 28 of the third metal layer 2331 is capable of reducing the resonance point in the high frequency characteristic of the high-speed connector 100, so the oscillation is reduced to improve the high frequency characteristic of the high-speed connector 100. The high-speed connector 100 is capable of improving the far-end crosstalk, the near-end crosstalk, the insertion loss and the return loss, so the performances of the far-end crosstalk, the near-end crosstalk, the insertion loss and the return loss are better.

Referring to FIG. 6 to FIG. 18, in the preferred embodiment, each pore 25 is shown as the square shape. In the concrete implementation, each pore 25 is any shape, and the pattern 28 is any shape. The pattern 28 is able to be composed by the at least two groups of the pores 25, and the plurality of the pores 25 of the at least two groups are different. When the pattern 28 is composed by the three groups of the pores 25, the three groups of the pores 25 include the first group of the pores 25, the second group of the pores 25 and the third group of the pores 25. Each pore 25 of the first group is shown as a fan shape, each pore 25 of the second group is shown as a triangle shape, and each pore 25 of the third group is shown as an oval shape.

In the preferred embodiment, the pattern 28 of the first metal layer 2131 and the pattern 28 of the second metal layer 2231 are different from the pattern 28 of the third metal layer 2331. The pattern 28 of the third metal layer 2331 is able to be cooperated with an overall structure of the third terminal assembly 23 to be designed.

In the preferred embodiment, a quantity of the plurality of the third ribs 2332 is six. Several of the third grounding terminals 2315 are corresponding to the plurality of the third ribs 2332. Bottom surfaces of the third fastening portions 2311 of the several of the third grounding terminals 2315 contact with the third metal layer 2331 which is attached to the top surfaces of the plurality of the third ribs 2332 to form the grounding structure 26. Specifically, the bottom surfaces of the third fastening portions 2311 of the six third grounding terminals 2315 contact with six third contacting areas 2333 of the third metal layer 2331 which is attached to the top surfaces of the six third ribs 2332 to form the grounding structure 26. In this way, the signal noise is able to be effectively absorbed and suppressed for improving the transmission quality of the high-frequency signal.

Referring to FIG. 5 to FIG. 23, the fourth terminal assembly 24 is corresponding to the third terminal assembly 23 along the up-down direction. The fourth terminal assembly 24 includes a plurality of fourth terminals 241, a fourth base body 242 and a fourth shielding plate 243. The plurality of the fourth terminals 241 are fastened to the fourth base body 242. The plurality of the fourth terminals 241 are partially surrounded by the fourth base body 242. The fourth shielding plate 243 is disposed under the fourth base body 242.

Each fourth terminal 241 has a fourth fastening portion 2411, a fourth contact portion 2412 and a fourth soldering portion 2413. The plurality of the fourth terminals 241 include a plurality of fourth grounding terminals 2414 and a plurality of fourth signal terminals 2415. In the preferred embodiment, the plurality of the fourth terminals 241 include seven fourth grounding terminals 2414 and twelve fourth signal terminals 2415. In the preferred embodiment, each two adjacent fourth signal terminals 2415 are located between two fourth grounding terminals 2414. Each fourth signal terminal 2415 is used for transmitting the signals.

A front end of the fourth fastening portion 2411 extends frontward and then is arched upward to form the fourth contact portion 2412. The fourth contact portion 2412 projects beyond a front surface of the fourth base body 242. A rear end of the fourth fastening portion 2411 extends rearward, then is bent downward and is further bent rearward to form the fourth soldering portion 2413. The fourth soldering portion 2413 projects beyond a rear surface of the fourth base body 242. The plurality of the fourth soldering portions 2413 of the plurality of the fourth terminals 241 are soldered to the fourth soldering zone 34 of the circuit board 3.

Referring to FIG. 1 to FIG. 23, in the preferred embodiment, the third terminal assembly 23 and the fourth terminal assembly 24 are disposed between the first terminal assembly 21 and the second terminal assembly 22. The plurality of the third soldering portions 2314 of the third terminal assembly 23 and the plurality of the fourth soldering portions 2413 of the fourth terminal assembly 24 are disposed among the plurality of the first soldering portions 2115 of the first terminal assembly 21 and the plurality of the second soldering portions 2214 of the second terminal assembly 22. The plurality of the third soldering portions 2314 of the third terminal assembly 23 are disposed among the plurality of the first soldering portions 2115 of the first terminal assembly 21 and the plurality of the fourth soldering portions 2413 of the fourth terminal assembly 24. The plurality of the fourth soldering portions 2413 of the fourth terminal assembly 24 are disposed among the plurality of the second soldering portions 2214 of the second terminal assembly 22 and the plurality of the third soldering portions 2314 of the third terminal assembly 23.

The plurality of the fourth fastening portions 2411 of the plurality of the fourth terminals 241 are partially surrounded by the fourth base body 242. The fourth base body 242 has at least one location foot 2421, a fourth fastening groove 2422 and at least two fourth perforations 2423. In the preferred embodiment, the fourth base body 242 includes two location feet 2421, the fourth fastening groove 2422 and two fourth perforations 2423. At least one side of a top surface of the fourth base body 242 extends upward to form at least one location foot 2421. The at least one location foot 2421 of the fourth terminal assembly 24 is fastened to the at least one location hole 2322 of the third terminal assembly 23 to realize that the third terminal assembly 23 is located to the fourth terminal assembly 24, and that the third terminal assembly 23 is fastened to the fourth terminal assembly 24.

In the preferred embodiment, two sides of the top surface of the fourth base body 242 protrude upward to form two location feet 2421. The two location feet 2421 of the fourth terminal assembly 24 are used for fastening to the two location holes 2322 of the third terminal assembly 23 to realize that the third terminal assembly 23 is located to the fourth terminal assembly 24, and that the third terminal assembly 23 is fastened to the fourth terminal assembly 24. A front of a bottom surface of the fourth base body 242 is recessed inward to form the fourth fastening groove 2422. The fourth shielding plate 243 is fastened in the fourth fastening groove 2422. The at least two fourth perforations 2423 penetrate through the top surface and the bottom surface of the fourth base body 242. The plurality of the fourth fastening portions 2411 of the plurality of the fourth grounding terminals 2414 and the plurality of the fourth fastening portions 2411 of the plurality of the fourth signal terminals 2415 are partially exposed to the at least two fourth perforations 2423. Specifically, two sides of the fourth base body 242 define the two fourth perforations 2423 penetrating through the top surface and the bottom surface of the fourth base body 242. The plurality of the fourth fastening portions 2411 of the plurality of the fourth grounding terminals 2414 and the plurality of the fourth fastening portions 2411 of the plurality of the fourth signal terminals 2415 are partially exposed to the two fourth perforations 2423. The fourth fastening portions 2411 of six fourth grounding terminals 2414 are exposed to the two fourth perforations 2423 of the two sides of the fourth base body 242. The fourth fastening portion 2411 of a middle fourth grounding terminal 2414 is surrounded by a middle of the fourth base body 242.

The fourth shielding plate 243 is disposed in the fourth fastening groove 2422 of the fourth base body 242. The fourth shielding plate 243 has a fourth base plate 2430, a fourth metal layer 2431 and a plurality of fourth ribs 2432. Several portions of an upper surface of the fourth shielding plate 243 extend upward to form the plurality of the fourth ribs 2432. The fourth metal layer 2431 is disposed on a top surface of the fourth base plate 2430 and top surfaces of the plurality of the fourth ribs 2432. Several portions of the top surface of the fourth base plate 2430 of the fourth shielding plate 243 extend upward to form the plurality of the fourth ribs 2432. In the concrete implementation, the fourth metal layer 2431 is formed on the top surface of the fourth base plate 2430 and the top surfaces of the plurality of the fourth ribs 2432 by the electroplating technology and the laser engraving technology etc. The fourth metal layer 2431 is formed on the top surface of the fourth base plate 2430 and the top surfaces of the plurality of the fourth ribs 2432 by the evaporation technology.

In the preferred embodiment, the fourth metal layer 2431 is designed to be the pattern 28 with the plurality of the pores 25, and the plurality of the pores 25 of the pattern 28 of the fourth metal layer 2431 are the same shape. The pattern 28 of the fourth metal layer 2431 is without being limited to the shape in accordance with the preferred embodiment. In the concrete implementation, the plurality of the pores 25 of the pattern 28 of the fourth metal layer 2431 is able to be different shapes. The plurality of the pores 25 are formed by the plurality of the interlaced lines 27 spread on the top surface of the fourth base plate 2430 and the top surfaces of the plurality of the fourth ribs 2432, so the signals partially penetrate through the plurality of the pores 25 of the fourth metal layer 2431, and the signals are partially reflected by the fourth metal layer 2431.

In the preferred embodiment, the pattern 28 of the fourth metal layer 2431 is capable of reducing the resonance point in the high frequency characteristic of the high-speed connector 100, so the oscillation is reduced to improve the high frequency characteristic of the high-speed connector 100. The high-speed connector 100 is capable of improving the far-end crosstalk, the near-end crosstalk, the insertion loss and the return loss, so the performances of the far-end crosstalk, the near-end crosstalk, the insertion loss and the return loss are better.

In the preferred embodiment, each pore 25 is shown as the square shape. In the concrete implementation, each pore 25 is any shape, and the pattern 28 is any shape. The pattern 28 is able to be composed by the at least two groups of the pores 25, and the plurality of the pores 25 of the at least two groups are different. When the pattern 28 is composed by the two groups of the pores 25, Each pore 25 of the one group is shown as the oval shape, and each pore 25 of the other group is shown as a diamond shape.

In the preferred embodiment, the pattern 28 of the first metal layer 2131, the pattern 28 of the second metal layer 2231, the pattern 28 of the third metal layer 2331 and the pattern 28 of the fourth metal layer 2431 are different. The pattern 28 of the fourth metal layer 2431 is able to be cooperated with an overall structure of the fourth terminal assembly 24 to be designed.

In the preferred embodiment, a quantity of the plurality of the fourth ribs 2432 is six. Several of the fourth grounding terminals 2414 are corresponding to the plurality of the fourth ribs 2432. Bottom surfaces of the fourth fastening portions 2411 of the several of the fourth grounding terminals 2414 contact with the fourth metal layer 2431 which is attached to the top surfaces of the plurality of the fourth ribs 2432 to form the grounding structure 26. Specifically, the bottom surfaces of the fourth fastening portions 2411 of the six fourth grounding terminals 2414 contact with six fourth contacting areas 2433 of the fourth metal layer 2431 which is attached to the top surfaces of the six fourth ribs 2432 to form the grounding structure 26. In this way, the signal noise is able to be effectively absorbed and suppressed for improving the transmission quality of the high-frequency signal.

In the preferred embodiment, a front of the first holding element 214 of the first terminal assembly 21 abuts against a rear of the second holding element 234 of the third terminal assembly 23. The bottom surface of the third base body 232 of the third terminal assembly 23 abuts against a top of the fourth base body 242 of the fourth terminal assembly 24. A front of the fourth base body 242 of the fourth terminal assembly 24 abuts against a rear of the second base body 222 of the second terminal assembly 22.

In the preferred embodiment, the pattern 28 of the first metal layer 2131 of the first terminal assembly 21, the pattern 28 of the second metal layer 2231 of the second terminal assembly 22, the pattern 28 of the third metal layer 2331 of the third terminal assembly 23 and the pattern 28 of the fourth metal layer 2431 of the fourth terminal assembly 24 are the same and have the plurality of the pores 25. Shapes of the first metal layer 2131, the second metal layer 2231, the third metal layer 2331 and the fourth metal layer 2431 are without being limited.

In practice, the first metal layer 2131 of the first terminal assembly 21, the second metal layer 2231 of the second terminal assembly 22, the third metal layer 2331 of the third terminal assembly 23 and the fourth metal layer 2431 of the fourth terminal assembly 24 are any shapes.

As described above, the first metal layer 2131 is mounted to the first base body 212, the second metal layer 2231 is mounted to the second base body 222, the third metal layer 2331 is mounted to the third base body 232 and the fourth metal layer 2431 is mounted to the fourth base body 242 of the terminal module 2 of the high-speed connector 100. The first metal layer 2131, the second metal layer 2231, the third metal layer 2331 and the fourth metal layer 2431 are the same patterns 28 with the plurality of the pores 25, and the plurality of the pores 25 of the patterns 28 may be different, so the signals partially penetrate through the first shielding plate 213, the second shielding plate 223, the third shielding plate 233 and the fourth shielding plate 243, and the signals are partially reflected by the first shielding plate 213, the second shielding plate 223, the third shielding plate 233 and the fourth shielding plate 243. As a result, the high-speed connector 100 is capable of reducing the resonance point, and the performances of the far-end crosstalk, the near-end crosstalk, the insertion loss and the return loss are better.

What is claimed is:

1. A high-speed connector, comprising:

an insulating housing; and a first terminal assembly mounted in the insulating housing, the first terminal assembly including a plurality of first terminals, a first base body and a first shielding plate, the plurality of the first terminals being fastened to the first base body, and the plurality of the first terminals being partially surrounded by the first base body, the first shielding plate being disposed under the first base body, the plurality of the first terminals including a plurality of first grounding terminals and a plurality of first signal terminals, each two adjacent first signal terminals being located between two first grounding terminals, the first shielding plate having a first base plate, a first metal layer and a plurality of first ribs, several portions of a top surface of the first base plate extending upward to form the plurality of the first ribs, the first metal layer being disposed on the top surface of the first base plate and top surfaces of the plurality of the first ribs, the first metal layer being a pattern with a plurality of pores, the plurality of the pores being formed by a plurality of interlaced lines, and the plurality of the interlaced lines being extended on the top surface of the first base plate and the top surfaces of the plurality of the first ribs, several of the first grounding terminals contacting with the first metal layer which is attached to the top surfaces of the plurality of the first ribs to form a grounding structure.

2. The high-speed connector as claimed in claim 1, wherein the plurality of the pores of the first metal layer are the same shape.

3. The high-speed connector as claimed in claim 1, wherein the plurality of the pores of the first metal layer are different shapes.

4. The high-speed connector as claimed in claim 1, wherein the first terminal assembly includes a first holding element, each first terminal has a first fastening portion, a first stepping portion, a first contact portion, a first bending portion and a first soldering portion, bottom surfaces of the plurality of the first fastening portions of the plurality of the first terminals are exposed to a bottom surface of the first base body, a front end of the first fastening portion is bent downward to form the first stepping portion, the first stepping portions of the plurality of the first terminals are mounted in a front end of the first base body, a front end of the first stepping portion extends frontward and then is arched downward to form the first contact portion, the first contact portion of each first terminal projects beyond a front surface of the first base body, a rear end of the first fastening portion extends rearward, then slantwise extends downward and rearward, and further extends downward to form the first bending portion, the first bending portion of each first terminal projects beyond a rear surface of the first base body, tail ends of the plurality of the first bending portions of the plurality of the first terminals are surrounded by the first holding element, the tail end of the first bending portion is bent rearward and extends rearward to form the first soldering portion, the plurality of the first soldering portions of the plurality of the first terminals are soldered to a first soldering zone of a circuit board.

5. The high-speed connector as claimed in claim 4, wherein the first base body surrounds rear ends of the plurality of the first fastening portions and the plurality of the first stepping portions, the first base body has a protrusion, a first fastening groove and at least two first perforations, a rear end of the bottom surface of the first base body extends downward to form the protrusion, a middle of the bottom surface of the first base body is recessed upward to form the first fastening groove, the first shielding plate is disposed in the first fastening groove of the first base body, two sides of the first base body define the at least two first perforations penetrating through a top surface and the bottom surface of the first base body, the plurality of the first fastening portions of the plurality of the first grounding terminals and the plurality of the first fastening portions of the plurality of the first signal terminals are partially exposed to the at least two first perforations.

6. The high-speed connector as claimed in claim 5, wherein the two sides of the first base body define two first perforations penetrating through the top surface and the bottom surface of the first base body, the first metal layer is formed on the top surface of the first base plate and the top surfaces of the plurality of the first ribs, the several of the first grounding terminals are corresponding to the plurality of the first ribs, a quantity of the plurality of the first ribs is six, the first fastening portions of six first grounding terminals are exposed to the two first perforations, the bottom surfaces of the first fastening portions of the six first grounding terminals contact with six first contacting areas of the first metal layer which is attached to the top surfaces of the six first ribs to form the grounding structure.

7. The high-speed connector as claimed in claim 6, wherein the first metal layer is formed on the top surface of the first base plate and the top surfaces of the plurality of the first ribs by an electroplating technology.

8. The high-speed connector as claimed in claim 7, further comprising a second terminal assembly corresponding to the first terminal assembly along an up-down direction, the second terminal assembly including a plurality of second terminals, a second base body and a second shielding plate, the plurality of the second terminals being partially surrounded by the second base body, the second shielding plate being disposed on the second base body, the second shielding plate having a second metal layer, the second metal layer being the pattern with the plurality of the pores.

9. The high-speed connector as claimed in claim 8, wherein each second terminal has a second fastening portion, a second stepping portion, a second contact portion and a second soldering portion, a front end of the second fastening portion is bent upward to form the second stepping portion, the second stepping portion is disposed in a front end of the second base body, a front end of the second stepping portion extends frontward and then is arched upward to form the second contact portion, the second contact portion projects beyond a front surface of the second base body, a rear end of the second fastening portion is bent downward and then extends rearward to form the second soldering portion, the plurality of the second soldering portions of the plurality of the second terminals are soldered to a second soldering zone of the circuit board, the plurality of the second terminals include a plurality of second grounding terminals and a plurality of second signal terminals, each two adjacent second signal terminals are located between two second grounding terminals.

10. The high-speed connector as claimed in claim 9, wherein lengths of the plurality of the first fastening portions of the plurality of the first terminals are longer than lengths of the plurality of the second fastening portions of the plurality of the second terminals along a longitudinal direction, lengths of the plurality of the first stepping portions of the plurality of the first terminals and lengths of the plurality of the second stepping portions of the plurality of the second terminals are the same along the longitudinal direction, lengths of the plurality of the first contact portions of the plurality of the first terminals and lengths of the plurality of the second contact portions of the plurality of the second terminals are the same along the longitudinal direction.

11. The high-speed connector as claimed in claim 9, wherein the second base body surrounds the plurality of the second fastening portions and the plurality of the second stepping portions of the plurality of the second terminals, the second base body has a second fastening groove and two second perforations, a middle of a top surface of the second base body is recessed downward to form the second fastening groove, the second shielding plate is disposed in the second fastening groove of the second base body, two sides of the second base body define the two second perforations penetrating through the top surface and a bottom surface of the second base body, the plurality of the second fastening portions of the plurality of the second grounding terminals and the plurality of the second fastening portions of the plurality of the second signal terminals are partially exposed to the two second perforations.

12. The high-speed connector as claimed in claim 11, wherein the second shielding plate has a second base plate, a second metal layer and a plurality of second ribs, the second metal layer is disposed under a bottom surface of the second base plate, several portions of the bottom surface of the second base plate of the second shielding plate extend downward to form the plurality of the second ribs, the second metal layer is formed on the bottom surface of the second base plate and bottom surfaces of the plurality of the second ribs, several of the second grounding terminals are corresponding to the plurality of the second ribs, the second fastening portions of six second grounding terminals are exposed to the two second perforations, a quantity of the plurality of the second ribs is six, top surfaces of the second fastening portions of the six second grounding terminals contact with six second contacting areas of the second metal layer which is attached to the bottom surfaces of the six second ribs to form the grounding structure.

13. The high-speed connector as claimed in claim 12, wherein the insulating housing has a main portion, an accommodating space, a plurality of terminal slots and a penetrating groove, an inside of the main portion defines the accommodating space, the penetrating groove penetrates through a middle of a front end of the main portion along a longitudinal direction, the plurality of the terminal slots are arranged in two rows, an upper portion of the main portion defines an upper row of the terminal slots penetrating through a front surface and a top surface of the main portion, a bottom surface of the upper portion of the main portion and a rear surface of the upper portion of the main portion, a lower portion of the main portion defines a lower row of the terminal slots penetrating through the front surface and a bottom surface of the main portion, a top surface of the lower portion of the main portion and a rear surface of the lower portion of the main portion, the upper row of the terminal slots and the lower row of the terminal slots are communicated with an upper portion and a lower portion of the accommodating space, respectively, the two rows of the terminal slots are connected with a front end of the accommodating space, the penetrating groove is communicated with the upper row of the terminal slots and the lower row of the terminal slots, the plurality of the first contact portions of the plurality of the first terminals are disposed in front ends of the upper row of the terminal slots, bottom surfaces of the plurality of the first contact portions of the plurality of the first terminals are exposed out of bottoms of the upper row of the terminal slots and project into the penetrating groove, the plurality of the second contact portions of the plurality of the second terminals are disposed in the lower row of the terminal slots, top surfaces of the plurality of the second contact portions of the plurality of the second terminals are exposed out of the lower row of the terminal slots and project into the penetrating groove.

14. The high-speed connector as claimed in claim 13, wherein a rear end of the main portion defines an assembling groove penetrating through a rear surface of the main portion, the penetrating groove is communicated between an outside and the front end of the accommodating space, the assembling groove is located behind the accommodating space, the first terminal assembly and the second terminal assembly are inserted into the accommodating space from the assembling groove of the insulating housing.

15. The high-speed connector as claimed in claim 9, further comprising a third terminal assembly corresponding to the first terminal assembly, the third terminal assembly including a plurality of third terminals, a third base body and a third shielding plate, the plurality of the third terminals being fastened to the third base body, the plurality of the third terminals being partially surrounded by the third base body, the third shielding plate being disposed under the third base body, the third shielding plate having a third base plate, several portions of a top surface of the third base plate of the third shielding plate extending upward to form a plurality of third ribs, the third base body having an indentation, at least one location hole, a third fastening groove and at least two third perforations, a middle of a rear end of a top surface of the third base body being recessed inward to form the indentation, the protrusion of the first terminal assembly being fastened to the indentation, at least one portion of a bottom surface of the third base body being recessed inward to form the at least one location hole, a middle of the bottom surface of the third base body being recessed inward to form the third fastening groove, the third shielding plate being disposed in the third fastening groove, the at least two third perforations penetrating through the top surface and the bottom surface of the third base body, each third terminal having a third fastening portion, the plurality of the third terminals including a plurality of third grounding terminals and a plurality of third signal terminals, the plurality of the third fastening portions of the plurality of the third grounding terminals and the plurality of the third fastening portions of the plurality of the third signal terminals being partially exposed to the at least two third perforations, the third shielding plate having a third metal layer, the third metal layer being the pattern with the plurality of the pores, bottom surfaces of the third fastening portions of six third grounding terminals contacting with six third contacting areas of the third metal layer which is attached to top surfaces of six third ribs to form the grounding structure.

16. The high-speed connector as claimed in claim 15, further comprising a fourth terminal assembly corresponding to the third terminal assembly along an up-down direction, the fourth terminal assembly including a plurality of fourth terminals, a fourth base body and a fourth shielding plate, the fourth shielding plate having a fourth base plate, several portions of a top surface of the fourth base plate of the fourth shielding plate extending upward to form a plurality of fourth ribs, the plurality of the fourth terminals being fastened to the fourth base body, the plurality of the fourth terminals being partially surrounded by the fourth base body, each fourth terminal having a fourth fastening portion, the plurality of the fourth terminals including a plurality of fourth grounding terminals and a plurality of fourth signal terminals, the fourth shielding plate being disposed under the fourth base body, the fourth base body having at least one location foot, a fourth fastening groove and at least two fourth perforations, at least one side of a top surface of the fourth base body extending upward to form at least one location foot, the at least one location foot being fastened to the at least one location hole of the third terminal assembly, a front of a bottom surface of the fourth base body being recessed inward to form the fourth fastening groove, the fourth shielding plate being disposed in the fourth fastening groove, the at least two fourth perforations penetrating through the top surface and the bottom surface of the fourth base body, the fourth shielding plate having a fourth metal layer, the fourth metal layer being the pattern with the plurality of the pores, bottom surfaces of the fourth fastening portions of six fourth grounding terminals contacting with six fourth contacting areas of the fourth metal layer which is attached to top surfaces of six fourth ribs to form the grounding structure.

17. The high-speed connector as claimed in claim 16, wherein the pattern of the first metal layer of the first terminal assembly, the pattern of the second metal layer of the second terminal assembly, the pattern of the third metal layer of the third terminal assembly and the pattern of the fourth metal layer of the fourth terminal assembly are the same.

18. The high-speed connector as claimed in claim 16, wherein the pattern of the first metal layer, the pattern of the second metal layer, the pattern of the third metal layer and the pattern of the fourth metal layer are different.

19. A high-speed connector, comprising:

an insulating housing;

a first terminal assembly mounted in the insulating housing, the first terminal assembly including a plurality of first terminals, a first base body and a first shielding plate, the plurality of the first terminals being partially surrounded by the first base body, the first shielding plate disposed under the first base body, the plurality of the first terminals including a plurality of first grounding terminals and a plurality of first signal terminals, each two adjacent first signal terminals being located between two first grounding terminals, the first shielding plate having a first base plate, a first metal layer and a plurality of first ribs, several portions of a top surface of the first base plate of the first shielding plate extending upward to form the plurality of the first ribs, the first metal layer being disposed on the top surface of the first base plate and top surfaces of the plurality of the first ribs, the first metal layer being designed to be a pattern with a plurality of pores, the plurality of the pores being formed by a plurality of interlaced lines, several of the first grounding terminals contacting with the first metal layer which is attached to the top surfaces of the plurality of the first ribs to form a grounding structure; and a second terminal assembly mounted in the insulating housing, the second terminal assembly being corresponding to the first terminal assembly, the second terminal assembly including a plurality of second terminals, a second base body and a second shielding plate, the plurality of the second terminals being partially surrounded by the second base body, the second shielding plate being disposed on the second base body, the plurality of the second terminals including a plurality of second grounding terminals and a plurality of second signal terminals, each two adjacent second signal terminals being located between two second grounding terminals, the second shielding plate having a second base plate, a second metal layer and a plurality of second ribs, several portions of a bottom surface of the second base plate of the second shielding plate extending downward to form the plurality of the second ribs, the second metal layer being disposed under the bottom surface of the second base plate and bottom surfaces of the plurality of the second ribs, the second metal layer being designed to be the pattern with the plurality of the pores, the plurality of the pores being formed by the plurality of the interlaced lines, several of the second grounding terminals contacting with the second metal layer which is attached to the bottom surfaces of the plurality of the second ribs to form the grounding structure.

20. A high-speed connector, comprising:

an insulating housing; and a terminal module mounted in the insulating housing, including:

a first terminal assembly including a plurality of first terminals, a first base body and a first shielding plate, the plurality of the first terminals being fastened to the first base body, and the plurality of the first terminals being partially surrounded by the first base body, the first shielding plate being disposed under the first base body, the plurality of the first terminals including a plurality of first grounding terminals and a plurality of first signal terminals, each two adjacent first signal terminals being located between two first grounding terminals, the first shielding plate having a first base plate, a first metal layer and a plurality of first ribs, several portions of a top surface of the first base plate of the first shielding plate extending upward to form the plurality of the first ribs, the first metal layer being disposed on the top surface of the first base plate and top surfaces of the plurality of the first ribs, the first metal layer being designed to be a pattern with a plurality of pores, the plurality of the pores being formed by a plurality of interlaced lines, several of the first grounding terminals contacting with the first metal layer which is attached to the top surfaces of the plurality of the first ribs to form a grounding structure;

a second terminal assembly corresponding to the first terminal assembly, the second terminal assembly including a plurality of second terminals, a second base body and a second shielding plate, the plurality of the second terminals being fastened to the second base body, the plurality of the second terminals being partially surrounded by the second base body, the second shielding plate disposed on the second base body, the plurality of the second terminals including a plurality of second grounding terminals and a plurality of second signal terminals, each two adjacent second signal terminals being located between two second grounding terminals, the second shielding plate having a second base plate, a second metal layer and a plurality of second ribs, several portions of a bottom surface of the second base plate of the second shielding plate extending downward to form the plurality of the second ribs, the second metal layer being disposed under the bottom surface of the second base plate and bottom surfaces of the plurality of the second ribs, the second metal layer being designed to be the pattern with the plurality of the pores, the plurality of the pores being formed by the plurality of the interlaced lines, several of the second grounding terminals contacting with the second metal layer which is attached to the bottom surfaces of the plurality of the second ribs to form the grounding structure;

a third terminal assembly including a plurality of third terminals, a third base body and a third shielding plate, the plurality of the third terminals being fastened to the third base body, the plurality of the third terminals being partially surrounded by the third base body, the third shielding plate being disposed under the third base body, the plurality of the third terminals including a plurality of third grounding terminals and a plurality of third signal terminals, each two adjacent third signal terminals being located between two third grounding terminals, the third shielding plate having a third base plate, a third metal layer and a plurality of third ribs, several portions of a top surface of the third base plate of the third shielding plate extending upward to form the plurality of the third ribs, the third metal layer being disposed on the top surface of the third base plate and top surfaces of the plurality of the third ribs, the third metal layer being designed to be the pattern with the plurality of the pores, the plurality of the pores being formed by the plurality of the interlaced lines, several of the third grounding terminals contacting with the third metal layer which is attached to the top surfaces of the plurality of the third ribs to form the grounding structure; and a fourth terminal assembly corresponding to the third terminal assembly, the fourth terminal assembly including a plurality of fourth terminals, a fourth base body and a fourth shielding plate, the fourth base body surrounding the plurality of the fourth terminals, the plurality of the fourth terminals being fastened to the fourth base body, the plurality of the fourth terminals being partially surrounded by the fourth base body, the fourth shielding plate disposed under the fourth base body, the plurality of the fourth terminals including a plurality of fourth grounding terminals and a plurality of fourth signal terminals, each two adjacent fourth signal terminals being located between two fourth grounding terminals, the fourth shielding plate having a fourth base plate, a fourth metal layer and a plurality of fourth ribs, several portions of a top surface of the fourth base plate of the fourth shielding plate extending upward to form the plurality of the fourth ribs, the fourth metal layer disposed on the top surface of the fourth base plate and top surfaces of the plurality of the fourth ribs, the fourth metal layer being designed to be the pattern with the plurality of the pores, the plurality of the pores being formed by the plurality of the interlaced lines, several of the fourth grounding terminals contacting with the fourth metal layer which is attached to the top surfaces of the plurality of the fourth ribs to form the grounding structure.

* * * * *